US007274363B2

(12) United States Patent
Ishizuka et al.

(10) Patent No.: US 7,274,363 B2
(45) Date of Patent: Sep. 25, 2007

(54) PANEL DISPLAY DRIVING DEVICE AND DRIVING METHOD

(75) Inventors: Shinichi Ishizuka, Tsurugashima (JP); Masami Tsuchida, Tsurugashima (JP); Hideo Ochi, Tsurugashima (JP); Tsuyoshi Sakamoto, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 463 days.

(21) Appl. No.: 10/322,776

(22) Filed: Dec. 19, 2002

(65) Prior Publication Data

US 2003/0122813 A1 Jul. 3, 2003

(30) Foreign Application Priority Data

Dec. 28, 2001 (JP) ..... 2001-401814
Dec. 28, 2001 (JP) ..... 2001-401815
Jul. 10, 2002 (JP) ..... 2002-201697

(51) Int. Cl.
*G09G 5/00* (2006.01)

(52) U.S. Cl. ..... 345/211

(58) Field of Classification Search ..... 345/76–78, 345/82, 84, 211–214
See application file for complete search history.

(56) References Cited

U.S. PATENT DOCUMENTS 5,583,527 A * 12/1996 Fujisaki et al. ..... 345/55
5,745,085 A * 4/1998 Tomio et al. ..... 345/63
5,828,354 A * 10/1998 Ebihara ..... 345/58
5,841,412 A * 11/1998 Ebihara ..... 345/58
5,949,194 A 9/1999 Kawakami et al.
5,973,655 A * 10/1999 Fujisaki et al. ..... 345/63
6,147,617 A * 11/2000 Kim ..... 340/664
6,278,421 B1 * 8/2001 Ishida et al. ..... 345/63
6,498,592 B1 * 12/2002 Matthies ..... 345/1.1
6,518,962 B2 * 2/2003 Kimura et al. ..... 345/211
6,633,135 B2 * 10/2003 Nara et al. ..... 315/169.3
6,707,437 B1 * 3/2004 Kuno et al. ..... 345/74.1
6,937,279 B1 * 8/2005 Kim et al. ..... 348/308
6,947,018 B1 * 9/2005 Yamazaki ..... 345/75.2
2002/0030647 A1 * 3/2002 Hack et al. ..... 345/82

(Continued)

FOREIGN PATENT DOCUMENTS

DE 100 09 204 A1 8/2001

(Continued)

*Primary Examiner*—Sumati Lefkowitz
*Assistant Examiner*—Rodney Amadiz
(74) *Attorney, Agent, or Firm*—Sughrue Mion Pllc.

(57) ABSTRACT

A display panel driving device and driving method for providing high quality images without irregular luminance even after long-time use. The value of the light-emission drive current flowing when causing each light-emission elements bearing each pixel to independently emit light in succession is measured, then the luminance is corrected for each input pixel data based on the above light-emission drive current values, associated with the pixels corresponding to the input pixel data. According to another aspect, the voltage value of the drive voltage is adjusted in such a manner that one value among each measured light-emission drive current value becomes equal to a predetermined reference current value. According to a further aspect, the current value is measured while an off-set current component corresponding to a leak current of the display panel is added to the current outputted from the drive voltage generator circuit and the resultant current is supplied to each of the pixel portions.

46 Claims, 21 Drawing Sheets

U.S. PATENT DOCUMENTS

2002/0180821 A1* 12/2002 Kimura et al. ..... 345/211

FOREIGN PATENT DOCUMENTS

| | | | |
|---|---|---|---|
| EP | 0 905 673 | A1 | 3/1999 |
| EP | 0 923 067 | A1 | 6/1999 |
| EP | 1 227 466 | A2 | 7/2002 |
| JP | 10031449 | A * | 2/1998 |
| WO | WO98/52182 | A1 | 11/1998 |
| WO | WO 01/95301 | A1 | 12/2001 |

* cited by examiner

PANEL DISPLAY DRIVING DEVICE AND DRIVING METHOD

BACKGROUND OF THE INVENTION

1. Field of the Invention

The present invention relates to an active matrix-type display panel driving device and a driving method for same.

2. Description of the Related Art

In recent years, electroluminiscent display devices (henceforth referred to as EL display devices) incorporating a display panel using organic electroluminiscent elements (henceforth referred to as EL elements) as light-emission elements carrying pixels have drawn considerable attention. Driving methods for panel displays using those EL display devices known in the prior art include simple matrix drives and active matrix drives. EL display devices with active matrix drives are advantageous in that they consume less power than simple matrix types, and have a smaller cross-talk between pixels, being especially appropriate for large-screen or high resolution displays.

FIG. 1 is a diagram showing the basic structure of an active matrix drive type EL display device.

As shown in FIG. 1, the EL display device comprises a display panel 10, and a driving device 100 to drive this display panel 10 according to an image signal.

The display panel 10 is constituted by an anode power line 16, a cathode power line 17, scanning lines $A_1$ to $A_n$ (scanning electrodes) constituting n horizontal scanning lines on one screen, and m data lines (data electrodes) $B_1$ to $B_m$ arranged in such a manner that they intersect each of the scanning lines $A_1$ to $A_n$. Also, a drive voltage Vc is applied to the anode power line 16 and a ground potential GND is applied to the cathode power line 17. Furthermore, EL units $E_1$, 1 to $E_{n,m}$ bearing pixels are formed at each of the points of intersection of the scanning lines $A_1$ to $A_n$ and the data lines $B_1$ to $B_m$ in the above display panel 10.

FIG. 2 is a diagram showing the internal structure of an embodiment of an EL unit E formed at the intersection of one scanning line A and one data line B.

In FIG. 2, the gate G of a selective FET (Field Effect Transistor) 11 is connected to scanning line A and its drain D is connected to data line B. The gate G of a FET 12, the transistor for the light-emission drive, is connected to the source S of the FET 11. A drive voltage Vc is applied to the FET 12 through the anode power line 16, and a capacitor 13 is connected between the gate G and the source S. Further, the anode terminal of an EL element 15 is connected to the drain D of the FET 12. A ground potential GND is applied to the cathode end of the EL element 15 through the cathode power line 17.

The driving device 100, selectively applies scanning pulses in sequence to each scanning line $A_1$ to $A_n$ of the display panel 10. Also, the driving device 100 generates pixels data pulses $DP_1$ to $DP_m$ according to the input image signal corresponding to each horizontal scanning line, with a timing synchronised with the application of the above scanning pulses, and applies them to the data lines $B_1$ to $B_m$ respectively. Each pixel data pulse DP has a pulse voltage according to the luminance level indicated by the input image signal. Now each EL unit connected to scanning line A to which a scanning pulse has been applied becomes the target for the writing of the pixel data. The FET 11 inside the EL unit E, which has now become the target for the writing of the pixel data, is placed in an on-state in response to the above scanning pulse and applies the above pixel data pulse DP, supplied through the data line B, to the gate G of the FET 12 and the capacitor 13, respectively. The FET 12 generates a light-emission drive current according to the pulse voltage of the pixel data pulse DP, and supplies it to the EL element 15. The EL element 15 emits then light according to this light-emission drive current with a luminance determined by the pulse voltage of the above pixel data pulse DP. Meanwhile, capacitor 13 charges according to the pulse voltage of the above pixel data pulse DP. By means of this charging action, the pulse voltage according to the luminance level indicated by the input image signal is held thus achieving the so-called pixel data writing. When released by the target for the writing of the pixel data, the FET 11 is placed in an off-state, and the supply of the pixel data pulse DP to the gate G of the FET 12 stops. In the meantime however, since the voltage held by capacitor 13 as described above continues to be applied to the gate G of the FET 12, the FET 12 keeps on sending continuously the above light-emission drive current to the EL element 15.

One of the features of the EL element 15 is that the resistance value of the element itself increases gradually after prolonged light-emission times. Since the frequency of light-emission is different in response to the input image signal for each EL element 15 in the EL units $E_{1,1}$ to $E_{n,m}$ supported by the display panel 10, differences in the accumulated light-emission time occur. Therefore, when the display panel 10 is driven for a prolonged time, the resistance value of the EL elements becomes non-uniform, causing a variance in light-emission luminance which results in problems such as an irregular luminance across the screen and screen burning.

An object of the present invention is to solve the above problems, by providing a display panel driving device and a drive method for same that can be used for a prolonged time and allows the display of high quality images without irregularity.

Also, since the light-emission frequencies as per the input image signal are different for each of the EL elements 15 within the above EL units $E_{1,1}$ to $E_{n,m}$, differences in the accumulated light-emission time occur. Therefore, when the display panel 10 is driven for a prolonged time, the resistance value of the EL elements becomes non-uniform, causing a variance in light-emission luminance which results in problems such as an irregular luminance across the screen and screen burning.

The present invention further solves the above problems by providing a display panel driving device and a drive method for same which can permanently keep the luminance level within a given range across the screen, thus preventing the occurrence of luminance irregularity within the screen.

The display panel driving device according to a first aspect of the present invention is a display panel driving device for driving a display panel formed by a matrix-type arrangement of a plurality of emitting elements supporting pixels, the above display panel driving device comprising:

a drive voltage generator circuit which supplies a drive voltage through a power line to each of a plurality of emitting elements;

a current mesuring part for obtaining the current value corresponding to each pixel by fetching the value of current flowing in the above power line while causing each emitting element to independently emit light in succession, with the timing of the light-emission time of each emitting element, and to store it in a memory as the measured current value assigned to each pixel;

a luminance correction part for obtaining luminance-corrected pixel data by correcting the luminance level indicated by the pixel data of each pixel-corresponding to an input image signal, based on the above measured current value stored in the memory for the one pixel according to the pixel data; and light-emission drive part for causing the above light-emission elements to emit light only for the period corresponding to the luminance-corrected pixel data during the image display light-emission periods in each frame period of the above input image signal.

Also, the display panel driving method according to the first aspect of the present invention is a display panel driving method for driving a display panel formed by a matrix-type arrangement of a plurality of emitting elements supporting pixels, the display panel driving method comprising the steps of:

a current measuring step for obtaining the current value corresponding to each pixel by fetching the value of current flowing in the above power line while causing each emitting element to independently emit light in succession, with the timing of the light-emission time of each emitting element;

a luminance correction step for obtaining luminance-corrected pixel data by correcting the luminance level indicated by the pixel data of each pixel corresponding to the input image signal, by means of the above measured current value stored in the above memory for the above one pixel according to the above pixel data; and a light-emission drive step for causing the above light-emission elements to emit light only for the period corresponding to the above luminance-corrected pixel data in the image display light-emission periods within each frame period in the above input image signal.

The display panel driving device according to a second aspect of the present invention is a display panel driving device for driving, based on an input image signal, a display panel formed by a matrix-type arrangement of a plurality of emitting elements supporting pixels, the above display panel driving device comprising:

a drive voltage generator circuit which supplies a drive voltage through a power line to each of a plurality of emitting elements;

a current mesuring part for obtaining the current value corresponding to each pixel by fetching the value of current flowing in the above power line while causing each emitting element to independently emit light in succession, with the timing of the light-emission time of each emitting element, and to store it in a memory as the measured current value assigned to each pixel; and drive voltage adjustment part for adjusting the voltage value of the above drive voltage in such a manner that one value among each measured light-emission drive current value becomes equal to a predetermined reference current value.

The display panel driving device according to a third aspect of the present invention is a display panel driving device for driving, based on an input image signal, a display panel formed by a matrix-type arrangement of a plurality of emitting elements supporting pixels, the above display panel driving device comprising:

a drive voltage generator circuit which supplies a drive voltage through a power line to each of a plurality of emitting elements;

a current mesuring part for obtaining the current value corresponding to each pixel by fetching the value of current flowing in the above power line while causing each emitting element to independently emit light in succession, with the timing of the light-emission time of each emitting element, and to store it in a memory as the measured current value assigned to each pixel;

drive voltage adjustment part for adjusting the voltage value of the above drive voltage in such a manner that one value among each measured light-emission drive current value becomes equal to a predetermined reference current value.

a luminance correction part for obtaining luminance-corrected pixel data by correcting the luminance level indicated by the pixel data of each pixel corresponding to the above input image signal, by means of the above measured current value stored in the above memory for the above one pixel according to the above pixel data; and light-emission drive part for causing the above light-emission elements to emit light only for the period corresponding to the above luminance-corrected pixel data during the image display light-emission periods in each frame period of the above input image signal.

Also, the display panel driving method according to the second aspect of the present invention is a display panel driving method for driving, based on an input image signal, a display panel formed by a matrix-type arrangement of a plurality of emitting elements supporting pixels, the above display panel driving method comprising the steps of:

a current measuring step for obtaining the current value corresponding to each pixel by fetching the value of current flowing in the above power line while causing each emitting element to independently emit light in succession, with the timing of the light-emission time of each emitting element; and a drive voltage adjustment step for adjusting the voltage value of the above drive voltage in such a manner that one value among each measured light-emission drive current value becomes equal to a predetermined reference current value.

Also, the display panel driving method according to the third aspect of the present invention is a display panel driving method for driving, based on an input image signal, a display panel formed by a matrix-type arrangement of a plurality of emitting elements supporting pixels, the above display panel driving method comprising the steps of:

obtaining the current value corresponding to each pixel by fetching the value of current flowing in the above power line while causing each emitting element to independently emit light in succession, with the timing of the light-emission time of each emitting element;

obtaining luminance-corrected pixel data by correcting the luminance level indicated by the pixel data of each pixel corresponding to the input image signal, by means of the above measured current value stored in the above memory for the above one pixel according to the above pixel data; and causing the above light-emission elements to emit light only for the period corresponding to the above luminance-corrected pixel data during the image display light-emission periods in each frame period of the above input image signal.

A driving apparatus of a display panel according to the fourth aspect of the present invention is a driving apparatus of a display panel having a plurality of pixel portions arranged therein and each comprising a series circuit of a light light-emission element and a switch element, for driving the display panel in response to an input image signal, comprising: a drive voltage generator for applying a drive voltage to the series circuit of each of said plurality of pixel portions; a current measuring part for measuring a value of a current supplied from said drive voltage generator to the series circuit of each of said plurality of pixel portions; a current supplying part for adding to said current supplied from said drive voltage generator an off-set current component corresponding to a leak current of said display panel, and supplying a resultant current to the series circuit of each of said plurality of pixel portions; a memory control part for storing in memory a measured current value by said current measuring part at a light-emission timing correspondingly to each of said plurality of pixel portions while sequentially causing said light-emission element to singularly emit light for each of said plurality of pixel portions, by respectively turning on said switch element of each of said plurality of pixel portions; and a luminance corrector for correcting the light-emission luminance output of the light emitting device of each of said plurality of pixel portions based on a corresponding one of measured current values stored in said memory.

A driving method of according to the fourth aspect of the present invention is a display panel driving method for a display panel having a plurality of pixel portions arranged in a matrix form and each comprising a series circuit of a light-emission element and a switch element, for driving the display panel in accordance with an input image signal, comprising: applying an output drive voltage of a drive voltage generator to the series circuit of each of said plurality of pixel portions; supplying an addition value obtained by adding an off-set current component corresponding to a leak current of said display panel to said current supplied from said drive voltage generator, to the series circuit of each of said plurality of pixel portions; measuring a value of a current supplied from said drive voltage generator to the series circuit of each of said plurality of pixel portions; storing in memory a measured current value by measuring an output current value from said driving voltage generator at a light-emission timing correspondingly to each of said plurality of pixel portions while sequentially causing said light-emission element to singularly emit light for each of said plurality of pixel portions, by respectively turning on said switch element of each of said plurality of pixel portions; and correcting the light-emission luminance output of the light emitting device of each of said plurality of pixel portions based on a corresponding one of measured current values stored in said memory.

DETAILED DESCRIPTION OF THE PREFERRED EMBODIMENTS

Preferred embodiments of the present invention will now be described in detail with reference to the accompanying drawings.

Figure 3:
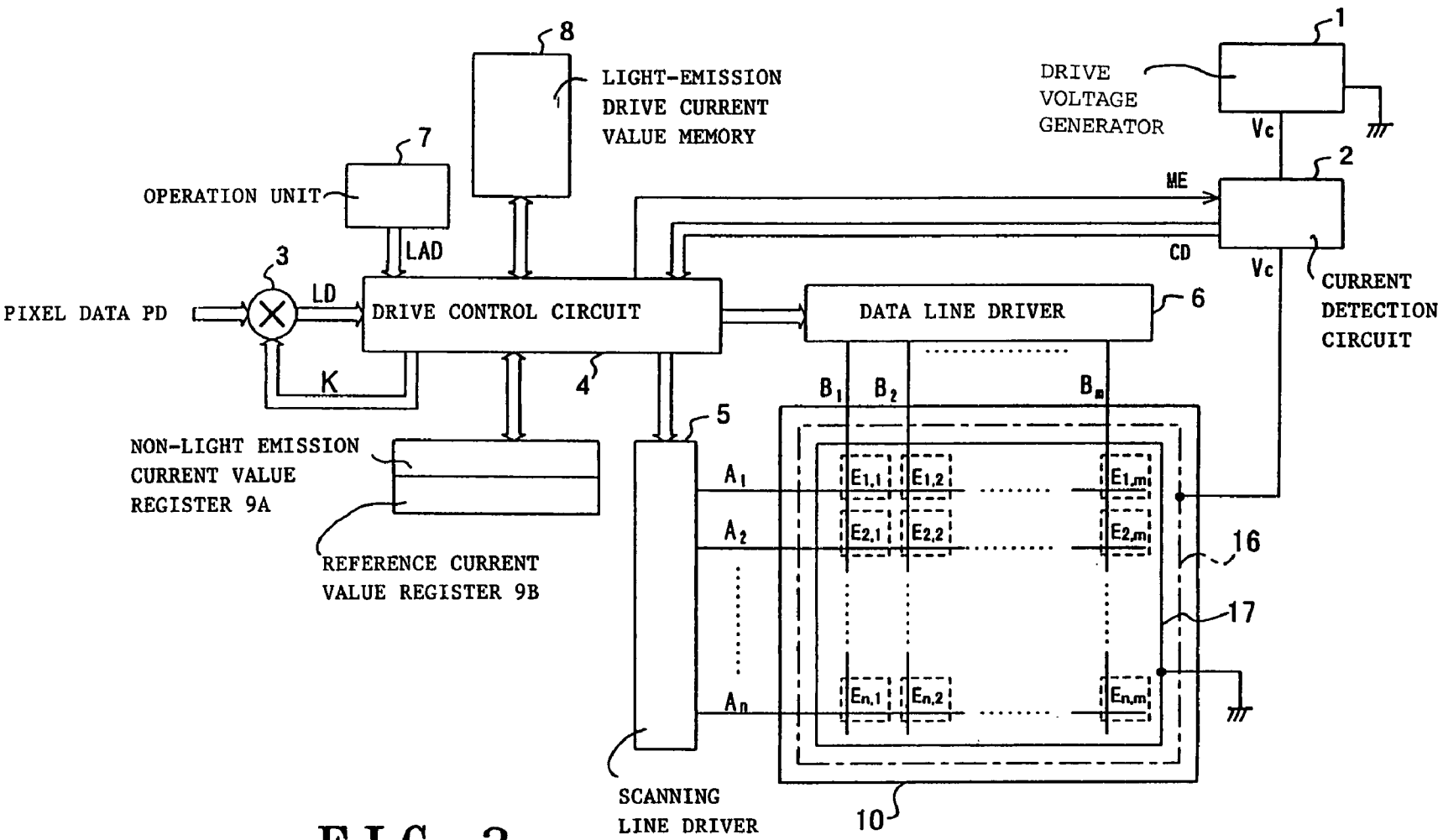
FIG. 3 is a schematic diagram showing the structure of an active matrix drive type EL display device according to the present invention.

FIG. 3 is a schematic diagram showing the structure of an embodiment of an electroluminiscent active matrix drive type EL display device according to the present invention (henceforth referred to as EL display device)

As shown in FIG. 3, this EL display device comprises a drive voltage generator circuit 1, a current detection circuit 2, a multiplier 3, a drive control circuit 4, a scanning line driver 5, a data line driver 6, an operation unit 7, a light-emission drive current memory 8, a non-light emission current value register 9A, a reference current value register 9B and a display panel 10.

The display panel 10 is formed by an anode power line 16, a cathode power line 17, 1 screen having n horizontal scanning lines $A_1$ to $A_n$, and m data lines $B_1$ to $B_m$ arranged in such a manner that they intersect each other. Also, a drive voltage Vc is applied to the anode power line 16 and a ground potential GND is applied to the cathode power line 17. Furthermore, EL units $E_{1,1}$ to $E_{n,m}$ bearing pixels are formed at each of the points of intersection of the scanning lines $A_1$ to $A_n$ and the data lines $B_1$ to $B_m$ in the above display panel 10. The inner structure of the EL units E is the same as the described above for FIG. 2, so it will be not be explained here.

The drive voltage generator circuit 1 generates the above DC drive voltage Vc and applies it to the anode power line 16 of the display panel 10 through the current detector circuit 2.

Figure 4:
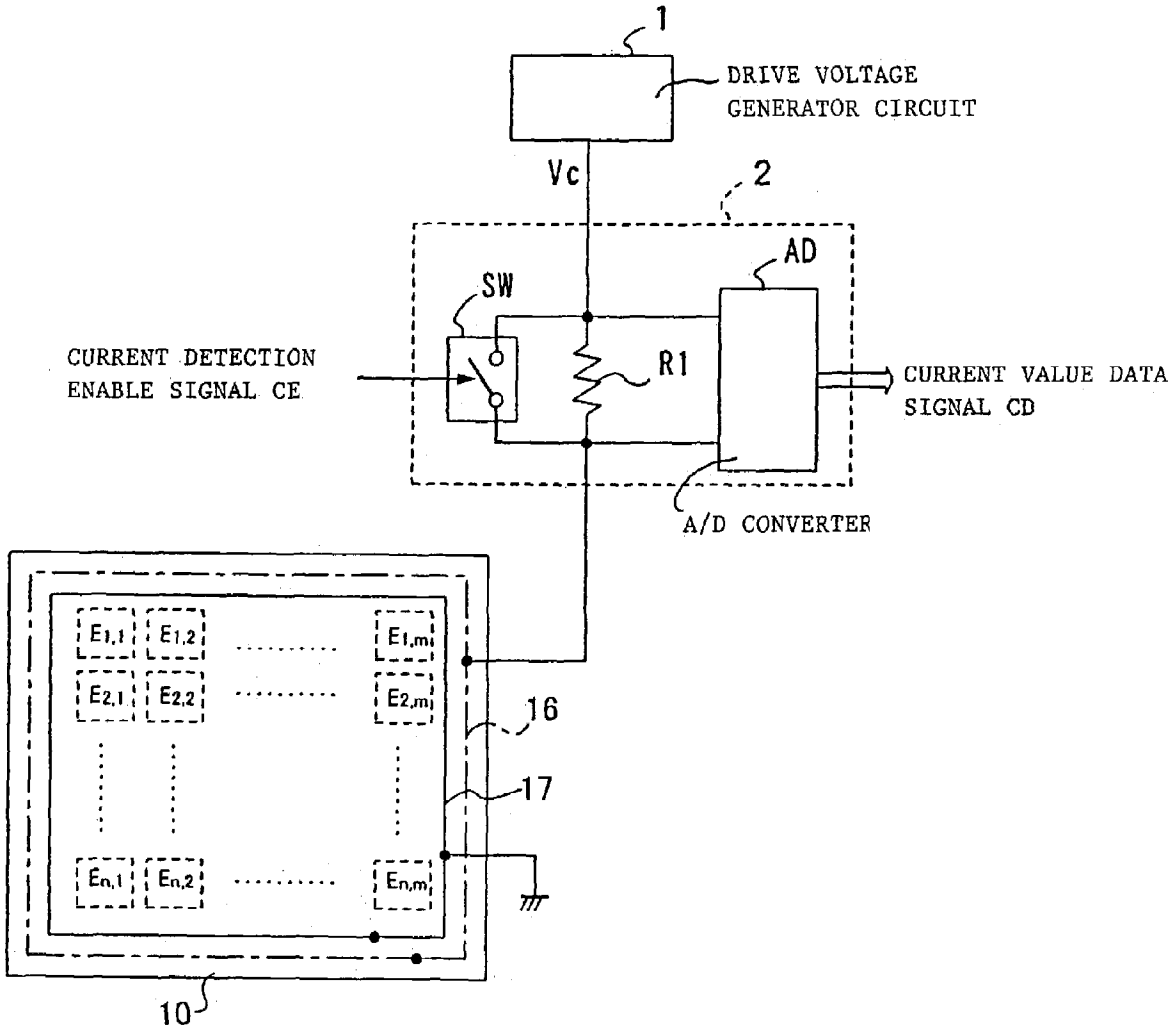
FIG. 4 is a schematic diagram showing an embodiment of the inner structure of a current detection circuit 2.

The current detection circuit 2 detects the current flowing in the anode power line 16 and supplies the current value data signal CD, indicating the value of the detected current, to the drive control circuit 4. The current detection circuit 2, for instance as shown in FIG. 4, comprises a resistor R1 connected between the drive voltage generator circuit 1 and the negative power line 16 of display panel 10, a measuring switch SW and an A/D converter AD. The measuring switch SW remains switched off when a current detection enable signal CE of logical level 1 is supplied by the drive control circuit 4, and switches on when a current detection enable signal CE of logical level 0 is supplied thus shorting the two ends of resistor R1. That is, while the measuring switch SW is off, the current detection circuit 2 is in detection mode, and supplies the voltage generated in both ends of resistor 1, according to the current value, to the A/D converter AD. Then the AD converter A/D supplies the value resulting from the conversion of the voltage generated in both ends of resistor 1 into a digital value to the drive control circuit 4, as the current value data signal CD.

The pixel data PD of each pixel according to the image signal carrying the image to be displayed in the display panel 10 above are then supplied in succession to the multiplier 3. The pixel data PD describe the display luminance level for each pixel. The multiplier 3 multiplies the supplied pixel data PD for each pixel by the luminance correction value K supplied by the drive control circuit 4, to obtain luminance-corrected pixel data LD, which it then supplies to the drive control circuit 4. That is, every time pixel data PD for each of the EL units $E_{1,1}$ to $E_{n,m}$ carrying the pixels of the display panel 10 are inputted in succession, the drive control circuit 4 reads in the light-emission drive current value memory 8 the measured current value for each pixel measured previously, and based on these measured current values, it generates the luminance correction value K and supplies it to the multiplier 3. The operations for the measuring of the current values of each pixel and the generation of the luminance correction level are described in detail below.

The operation unit 7 receives the actions of the user and supplies the corresponding command signals to the drive control circuit 4. For instance, the operation unit 7 supplies to the drive control circuit 4 a power on signal ON according to a power on operation instructed by the user in order to initiate the display operation in display panel 10. Similarly, the operation unit 7 supplies to the drive control circuit 4 a power off signal OFF according to a power off operation instructed by the user in order to terminate the display operation in display panel 10. Also, the operation unit 7 supplies to the drive control circuit 4 a luminance correction control signal LAD in response to a luminance correction instruction by the user.

The drive control circuit 4, according to the above power on signal ON, generates the above luminance correction value K (as described below) and controls the gradation drive of the display panel 10 that should display the half-tone luminance based on the above luminance-corrected pixel data LD. The gradation driving in display panel 10 can be carried out using any kind of gradation method, herein we shall describe an embodiment which utilises the sub-frame method.

In the sub-frame method, a 1 frame display period is subdivided into N sub-frames wherein different light-emission periods are allocated to the different sub-frames. The intermediate luminance is implemented in $(2^N+1)$ steps according to the luminance level indicated by the pixel data, and by deciding the way the sub-frames are to be combined to carry out the light-emission. The drive control circuit 4, by means of such sub-frame method, supplies the various drive control signals for driving the display panel 10 to the scanning line driver 5 and the data line driver 6.

Figure 5:
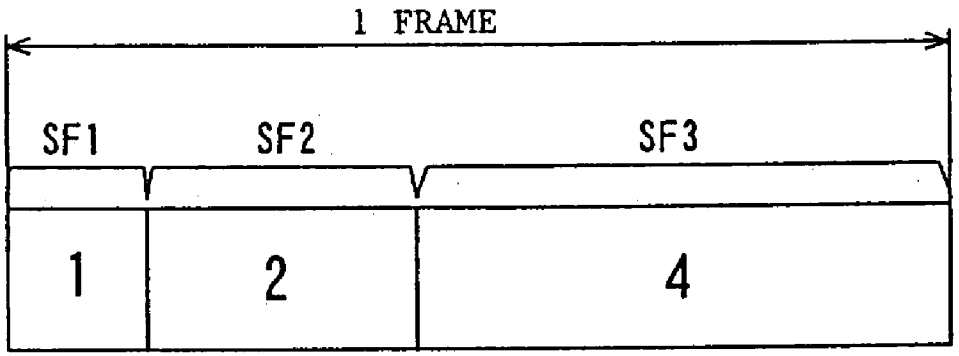
FIG. 5 is a diagram showing an embodiment of a light-emission drive format wherein driving involves dividing one frame light-emission period into three sub-frames SF1 to SF3.

The operation of the scanning line driver 5 and the data line driver 6 is explained below by means of an embodiment wherein a 1-frame display period is subdivided into 3 sub-frames SF1 to SF3, as depicted in FIG. 5.

During each of the 3 sub-frames SF1 to SF3 shown in FIG. 5, the scanning line driver 5 selectively applies a scanning pulse to each of the scanning lines $A_1$ to $A_n$ of the display panel 10. Meanwhile, the data line driver 6 applies the pixel data pulses $DP_1$ to $DP_m$ for each of the m luminance-corrected pixel data LD corresponding to each of the m pixels in each scanning line to each of the data lines $B_1$ to $B_m$, in synchrony with the application timing of the above scanning pulses. In case the EL units E are made to emit during that sub-frame, the pixel data pulse DP has a high voltage pulse, and a low voltage pulse (for instance 0 volt) in case of no light-emission. Now the EL unit E connected to the scanning line A to which the scanning pulse is applied becomes the target for the writing of the pixel data. The FET 11 inside the EL unit E, which has now become the target for the writing of the pixel data, is placed in an on-state in response to the above scanning pulse and applies the above pixel data pulses DP, supplied through data line B, to the gate G of the FET 12 and the capacitor 13, respectively. According to the pulse voltage of the pixel data pulse DP, the FET 12 generates a light-emission drive current (a current determined by the impedance of the EL element 15), and supplies it to the EL element 15. That is, if the EL element 15 is supplied a high-voltage pixel data pulse DP, the above light-emission drive current places it in a light-emission state. If it is supplied a low-voltage pixel data pulse DP, it is placed in a non-light emission state. Now, if a high-voltage pixel data pulse DP is supplied to the EL element 15 during the sub-frame SF1 shown in FIG. 5, this EL element 15 keeps on emitting during period "1". Also, if a high-voltage pixel data pulse DP is supplied to the EL element 15 during the sub-frame SF2, this EL element 15 keeps on emitting during period "2". If a high-voltage pixel data pulse DP is supplied to the EL element 15 during the sub-frame SF3, this EL element 15 keeps on emitting during period "4".

Therefore, if for instance only the sub-frame 3 among the sub-frames SF1 to SF3 emits, only the period "4" emits during an 1-frame display period, and the human eye perceives the luminance corresponding to the light-emission period "4". Also, if the sub-frames SF1 and SF3 emit, only the period "1"+"4"="5" emits during an 1-frame display period, and the human eye perceives the luminance corresponding to the light-emission period "5". Similarly, if the sub-frames SF2 and SF3 emit, only the period "2"+"4"="6" emits during an 1-frame display period, and the human eye perceives the luminance corresponding to the light-emission period "6".

Thus, when the display panel 10 is driven using the 3 sub-frames shown in FIG. 5, it is possible to implement a 9-gradation intermediate luminance.

Figure 6:
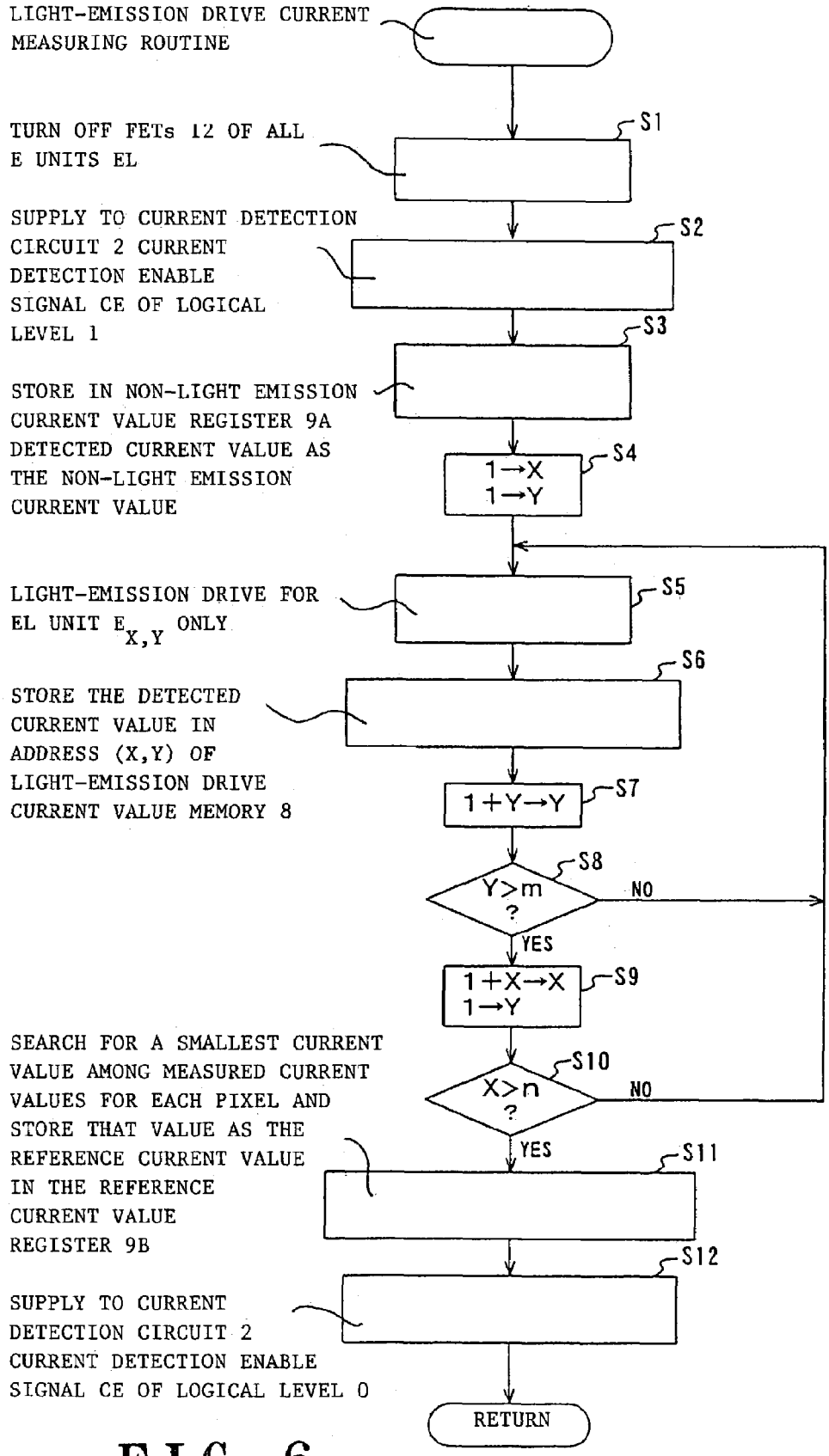
FIG. 6 is a flowchart describing the light-emission drive current measurement routine executed by the drive control circuit 4.

On the other hand, the drive control circuit 4 carries out the light-emission drive current measurement routine described in FIG. 6 in response to the above power off signal OFF.

In FIG. 6, firstly, the drive control circuit 4 supplies the drive control signal for placing the FET 12 of all the EL units $E_{1,1}$ to $E_{n,m}$ in the off state to the scanning line driver 5 and the data line driver 6 (step S1). Next, the drive control circuit 4 supplies the current detection enable signal CE of logical level 1 to the current detection circuit 2 (step 2). Thereby, the current detection circuit 2 detects the voltage generated between the ends of resistor R1 according to the current flowing in the anode power line 16 and supplies the current value data signal CD having that detected voltage value to the drive control circuit 4. That is, the current flowing in the anode power line 16 is detected when the operation of all the EL units $E_{1,1}$ to $E_{n,m}$ is interrupted. Next, the drive control circuit 4 stores the current value indicated by the current value data signal CD in the non-light emission current value register 9A, as the non-light emission value of current flowing to the display panel 10 when in non-display mode (step 3). Next, the drive control circuit 4 stores "1" as the initial row number in the row number register (not shown in the drawing) and stores "1" as the initial column number in the column number register (not shown in the drawing) (step 4). Next, the drive control circuit 4 supplies to the scanning line driver 5 and the data line driver 6 the drive control signal for driving the light-emission of only the EL unit $E_{X,Y}$ among the EL units $E_{1,1}$ to $E_{n,m}$ corresponding to the row number stored in the row number register X and the column number stored in the column number register Y (step S5). When performing this step S5, the scanning line driver 5 applies a scanning pulse only to the scanning lines $A_X$, among the scanning lines $A_1$ to $A_n$, indicated by the row number stored in the row number register X. At the same time, the data line driver 6 applies a high voltage pulse only to those data lines $B_Y$, among the data lines $B_1$ to $B_m$, indicated by the column numbers stored in the column number register Y, and applies a low-voltage pixel data pulse DP to the other groups of data lines B. By means of the above operation, a light-emission drive current flows only into the EL element 15 formed in the EL unit $E_{X,Y}$ among the EL units $E_{1,1}$ to $E_{n,m}$, in order for this EL element 15 to emit. Therefore, only the light-emission drive current consumed by the EL element 15 formed by the EL units $E_{X,Y}$ flows to the anode power line 16. Now the current detection circuit 2 supplies to the drive control circuit 4 the current value data signal CD indicating the value of the current flowing in the anode power line 16.

Herein, the drive control circuit 4, fetches the current value indicated by the above current value data signal CD and stores it in the address [X,Y] of the light-emission drive current value memory 8 as the measured current value (step 6). Next, the drive control circuit 4 increments the column number stored in the column in the column number register Y by only one (step S7). Next, the drive control circuit 4 checks whether or not the column number stored in the column number register Y is greater than the last column number m (step 8). In this step 8, if the column number stored in the column number register Y is not greater than the last column number m, the drive control circuit 4 jumps back to the step S5 above and repeats the operation described therein.

By repeating the above steps S5 to S8, the light-emission drive current flowing to the EL element 15, formed in all the EL units E1$_{,1}$ to $E_{n,m}$ in the scanning line $A_X$ indicated by the row number stored in the row register X, are measured one by one in succession and their values are stored in the light-emission drive current value memory 8.

On the other hand, in the step S8 above, if the column number stored in the column number register Y is verified to be greater than the last column number m, the drive control circuit 4 increments in only 1 the row number stored in the row number register X (step S7), and rewrites the column number stored in the column in the column number register Y by writing 1 (step S9). That is, by performing this step 9, the scanning line $A_x$, formed by the group of EL units E whose light-emission drive current is to be measured, moves to the next scanning line $A_{x+1}$. The drive control circuit 4 checks whether the row number stored in the row number register X is greater than the last row number n (step 10). In this step 8, if the row number stored in the row number register X is not greater than the last row number n, the drive control circuit 4 jumps back to the step S5 described above and repeats the operation described therein.

By repeating the above steps S5 to S10, the light-emission drive currents flowing to the EL elements 15 formed in all the EL units E1,1 to E1,m that form the display panel 10 are measured; and the measurement results are stored in the light-emission drive current value memory 8 associated with each pixel.

Also, in the above step S10, if the row number stored in the row number register X is greater than the last row number n, the drive control circuit 4 searches for the smallest current value among the measured current values of each pixel stored in the above light-emission drive current value memory 8, and stores that value in the reference current value register 9B (step S11). Next, the drive control circuit 4, supplies the current detection enable signal CE of logical level 0 to the current detection circuit 2 (step S12). Thus, the two ends of resistor R1 provided in the current detection circuit 2 short so the drive voltage Vc generated by the drive voltage generator circuit 1 is applied directly to the anode power line 16. After the above step S12 is completed, the drive control circuit 4 exits this light-emission drive current measurement routine to return to the main routine (not shown in the drawing).

The above light-emission drive current measurement routine is carried out in response to the current off operation [prompted] by the user for stopping the display operation in the display panel 10. That is, while the display operation based on the image data is not yet completed, the light-emission drive current flowing into the EL element 15 of each pixel, if emitting independently, is measured, and the result of the measurement is stored in light-emission drive current value memory 8 as the measured current value.

Now, when the user performs the power on operation using the operation unit 7 to initiate the display operation in the display panel 10, the operation unit 7 supplies a power on signal ON to the drive control circuit 4. In response to this power on signal ON, the drive control circuit 4 executes the luminance-corrected value generation routine described in FIG. 7, in order to generate the luminance correction value K.

Figure 7:
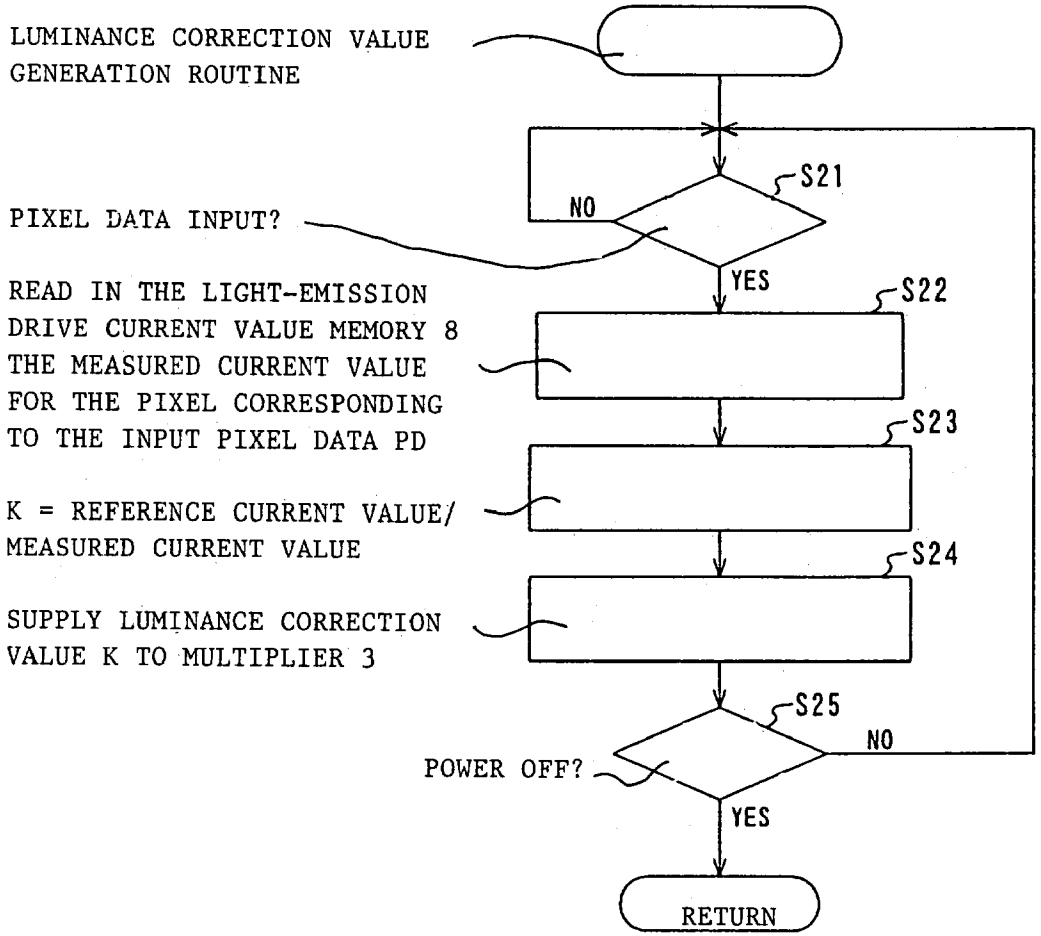
FIG. 7 is a flowchart describing the luminance correction value generation routine executed by the drive control circuit 4.

In FIG. 7, firstly, the drive control circuit 4 checks whether the pixel data PD have been inputted; this check is repeated until the pixel data PD are effectively inputted (step S21). In this step 21, when pixel data PD are inputted, the drive control circuit 4 reads from the light-emission drive current value memory 8 the measured current value corresponding to the pixel for the inputted pixel data PD (step S22). Next, the drive control circuit 4 determines the luminance correction value K, which is the result of dividing the reference current value $I_{REF}$, stored in the reference current value register 9B, by the above measured current value (step S23). This [K value] is the supplied to the multiplier 3 (step S24). Accordingly, the multiplier 3 generates for each pixel the luminance-corrected pixel data LD by means of the expression below:

$$LD = \text{pixel data } PD \cdot \text{luminance correction value } K$$
$$= \text{pixel data } PD \cdot (\text{reference current value } I_{REF} / \text{measured current value})$$

Next, the drive control circuit 4 checks whether a power off signal OFF has been supplied by the operation unit 7 (step S25). In step S25, if the power off signal OFF is supplied, the drive control circuit 4 returns to carry out step S21 above and repeats the operation described therein. If on the other hand, in step S25 a power off signal OFF has been supplied, the drive control circuit 4 exits this luminance correction value generation routine and moves on to execute the light-emission drive current measurement routine as described in FIG. 6.

By executing the above luminance correction value generation routine, when the light-emission drive current measured for each pixel becomes large with respect to the above reference current value $I_{REF}$, the luminance correction values generated are such that the light-emission periods of the EL elements 15 in the EL units corresponding to each pixel are shorter relative to the periods indicated in the pixel data PD. Thus, the luminance-corrected pixel data LD are obtained as the product of pixel data PD supplied for that pixel and the luminance correction value K above.

For instance, if the measured current value of the EL element 15 formed in the EL unit $E_{1,1}$ is 120% of the reference current value, the luminance correction value will be 0.83, and the luminance-corrected pixel data LD will be the result of the product of the supplied pixel data PD for this EL unit $E_{1,1}$ by 0.83. If the measured current value of the EL element 15 formed in the EL unit $E_{1,2}$ is 110% of the reference current value, the luminance correction value will be 0.91, and the luminance-corrected pixel data LD will be the result of the product of the supplied pixel data PD for this EL unit $E_{1,2}$ by 0.91.

That is, the luminance correction for the pixel data PD is carried out in such a manner that the light-emission period in each frame for an EL element 15 of large light-emission drive current becomes shorter compared with that of an EL element 15 of small light-emission drive current. That is, the light-emission luminance for an EL element 15 with a large light-emission drive current is greater than for an EL element 15 of small light-emission drive current, but by reducing in that amount only the light-emission period per frame in accordance with the pixel data PD corresponding to the El element 15, the luminance in the screen can have an homogenous aspect Thus, the display of high quality images without luminance irregularity is made possible even if luminance variance occurs for each of the EL elements corresponding to each pixel as a consequence of driving the display panel for a prolonged time.

Further, in the above embodiment, the smallest current value among the measured current values of each pixel stored in the light-emission drive current value memory 8 is taken as the reference current value $I_{REF}$, but also the largest current value can be taken as the reference current value $I_{REF}$. Now, as described in step S11 shown in FIG. 6, the drive control circuit 4 searches for the largest current value among the measured current values of each of the pixels stored in the light-emission drive current value memory 8 above, and stores that value in the reference current value register 9B as the reference current value. Thereby, luminance is corrected for the pixel data PD in such a way that the light-emission period per 1-frame lengthens for the EL element 15 to the extent that its light-emission drive current is smaller than that of the [benchmark] EL element 15 with the largest light-emission drive current. In this case, the luminance correction value K is always larger than 1. Now, for determining the luminance-corrected pixel data LD as the product of the luminance correction value K by the input pixel data, a further product by a predetermined coefficient (not larger than 1) is added. For instance, if that coefficient is 0.7, the luminance-corrected pixel data LD would be obtained through $$LD = \text{pixel data } PD \cdot 0.7 \cdot \text{luminance correction value } K$$
$$= \text{pixel data } PD \cdot 0.7 \cdot (\text{reference current value} / \text{measured current value})$$

In the above embodiment, the value for the light-emission drive current actually measured for each pixel is stored in the light-emission drive current value memory 8 as the measured current value, but also the difference between this measured current value and the reference current value $I_{REF}$ above could be stored in the light-emission drive current value memory 8 associated with each pixel.

Also, inside the display panel 10 some minute currents may be consumed other than the light-emission drive currents flowing to the EL elements 15 themselves. In such a case, in order to measure accurately the light-emission drive current flowing to the EL elements 15 themselves, the result of the subtraction of the non-light emission current value stored in the non-light emission current value register 9A from the current value detected by the current detection circuit 2 can also be stored in the light-emission drive current value memory 8 as the minimum measured current value.

Also, if the above measured current obtained measuring each of the light-emission drive currents flowing to each pixel has a current value outside a specified current value range, the drive control circuit 4 considers that the EL unit E carrying the pixel corresponding to that measured current value is malfunctioning, and can supply "0" as the luminance correction value K corresponding to that pixel to the multiplier 3. Now, multiplying 0 by the pixel data PD, the resulting luminance-corrected pixel data LD becomes 0, and the El element 15 corresponding to that pixel becomes permanently extinguished. That is, the drive control circuit 4 forbids the light-emission operation for the EL units E corresponding to malfunctioning pixels.

Figure 8:
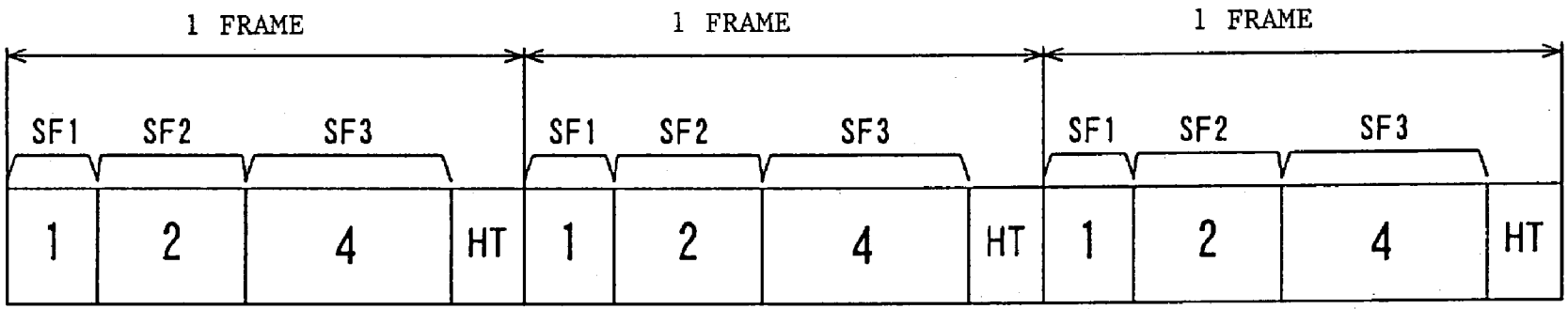
FIG. 8 is a diagram showing a light-emission drive format wherein in one frame display period there is provided a light-emission drive current measurement period HT.

In the above embodiment also, in response to the power off operation by the user, the light-emission drive current measurement routine shown in FIG. 6 is executed only once, but it can also be carried out repeatedly at regular intervals. Also, the timing for starting the execution of the above light-emission drive current measurement routine is not necessarily limited to [that of] the power off operation by the user. For instance, if the EL display device shown in FIG. 3 is integrated into any kind of portable information terminal device such as a cellular phone, etc., the execution of the above light-emission drive current measurement routine can also be carried out while that portable information terminal device is being charged, or while the display surface of the display panel 10 is closed. Also, it can also be executed forcibly in response to a luminance correction instruction from the user. Herein, if the operation unit 7, as requested by the luminance correction instruction device, supplies a luminance correction control signal LAD to the drive control circuit 4, the drive control circuit 4 executes the light-emission drive current measurement routine in response to the above luminance correction control signal LAD, as described in FIG. 6. Also, the light-emission drive current measurement routine above can be executed during a light-emission drive current measurement period HT within each frame, other than the sub-frames SF1 to SF3 described above, as shown in FIG. 8. That is, the light-emission drive current for each pixel is measured executing the light-emission drive current measurement routine in a period other than the pixel display light-emission periods comprising the sub-frames SF1 to SF3 for each frame.

In the above embodiment, the current detection circuit 2 that actually detects the light-emission drive current is provided between the drive voltage generator circuit 1 and the anode power line 16, but a current detection circuit can also be provided for each of the drive voltage generator circuits in case the drive voltage generator circuit 1 comprises a plurality of independent drive voltage generator circuits.

Figure 9:
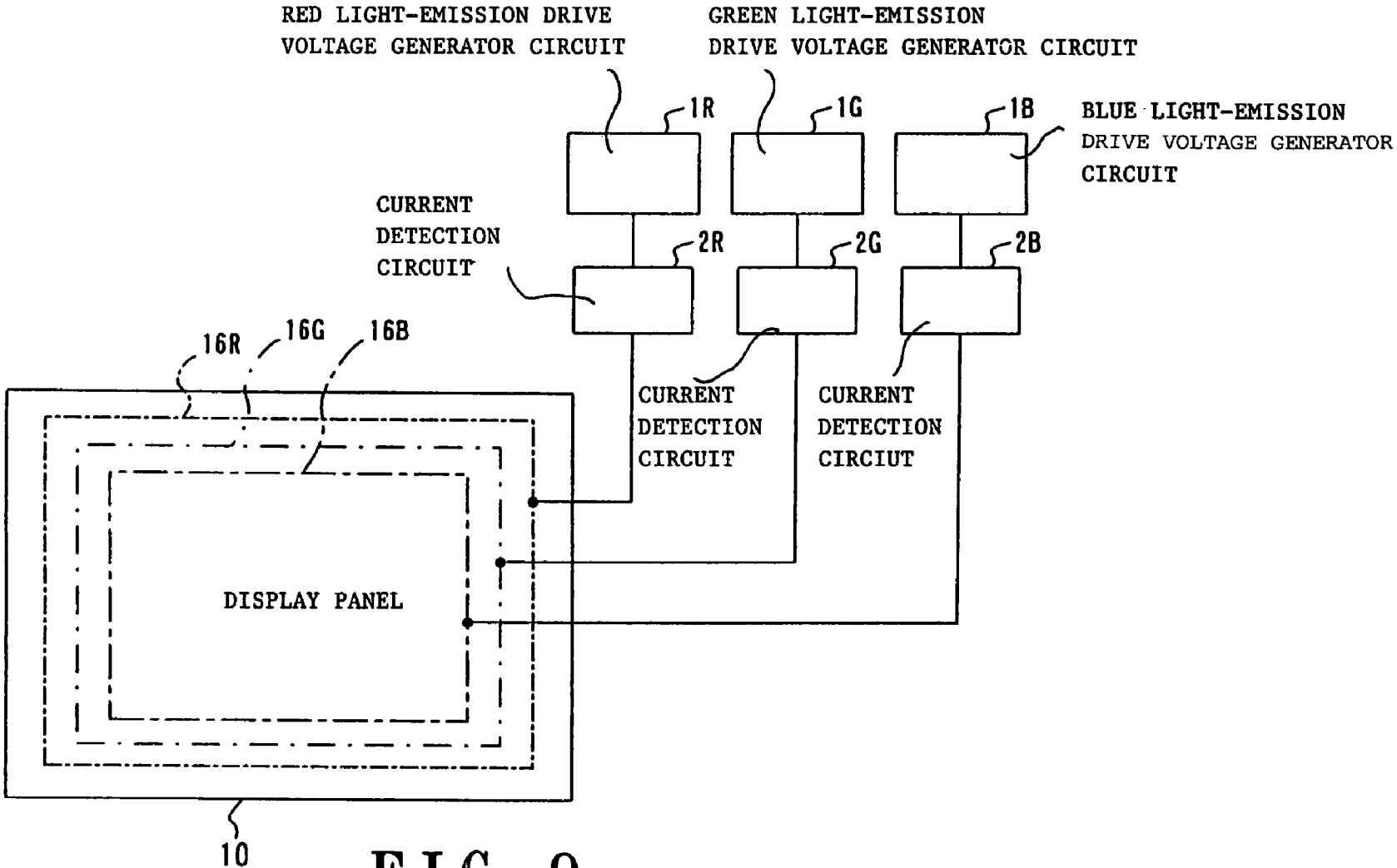
FIG. 9 is a schematic diagram showing an embodiment of the current detection circuit 2 having a drive voltage generator circuit provided specially for each color.

For instance, in FIG. 9, a red light-emission drive voltage generator circuit 1R, a green light-emission drive voltage generator circuit 1G and a blue light-emission drive voltage generator circuit 1B are provided independently as the drive voltage generator circuits. The red light-emission drive voltage generator circuit 1R supplies drive voltage to each EL unit E bearing red-light emission among the EL units $E_{1,1}$ to $E_{n,m}$ in the display panel 10 through an anode power line 16R. The green light emission drive voltage generator circuit 1G supplies drive voltage to each EL unit E bearing green-light emission among the EL units $E1_{,1}$ to $E_{n,m}$ in the display panel 10 through an anode power line 16G. The blue light emission drive voltage generator circuit 1B supplies drive voltage to each EL unit E bearing blue-light emission among the EL units $E_{1,1}$ to $E_{n,m}$ in the display panel 10 through an anode power line 16B. Thus currents can-be detected separately by providing a current detection circuit 2R between the red-light emission drive voltage generator circuit 1R and the anode power line 16R, a current detection circuit 2G between the green-light emission drive voltage generator circuit 1G and the anode power line 16G, and a current detection circuit 2B between the blue-light emission drive voltage generator circuit 1B and the anode power line 16B.

Figure 10:
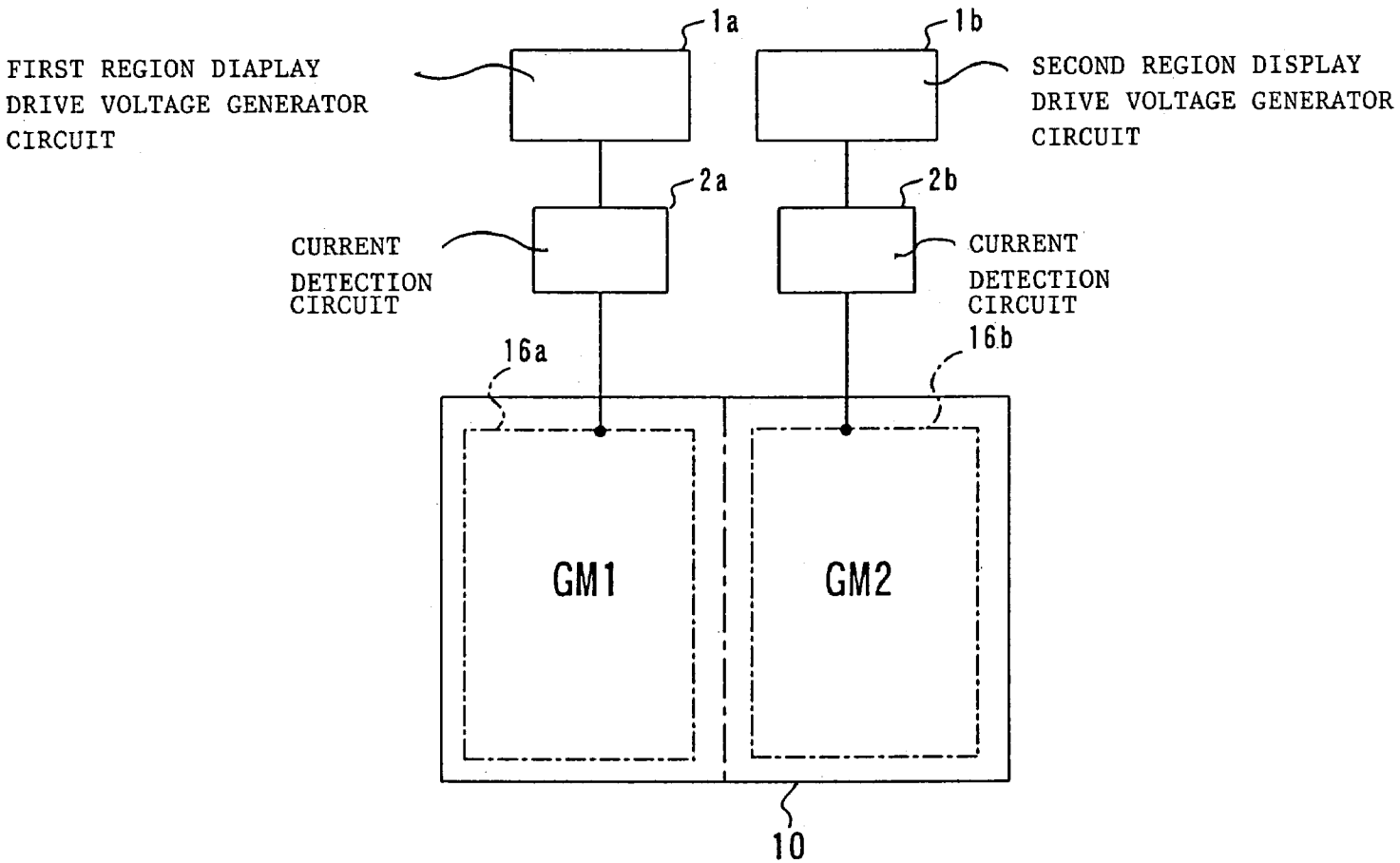
FIG. 10 is a schematic diagram showing an embodiment of the current detection circuit 2 having a drive voltage generator circuit provided specially for each screen region in the display panel 10.

Also, as shown in FIG. 10, a drive voltage generator circuit 1*a* for display in a first region and a drive voltage generator circuit 1*b* for display in a second region can be independently provided as the drive voltage generator circuit 1. The first-region drive voltage generator circuit 1*a* supplies drive voltage to each EL unit E bearing pixel display in a first screen region GM1, by way of an anode power line 16*a*. The second-region drive voltage generator circuit 1*b* supplies drive voltage to each EL unit E bearing pixel display in a second screen region GM2, by way of an anode power line 16*b*. Thus currents can be detected separately by providing a current detection circuit 2*a* between the first-region drive voltage generator circuit 1*a* and the anode power line 16*a*, and a current detection circuit 2*b* between the second-region drive voltage generator circuit 1*b* and the anode power line 16*b*. Moreover, one panel can be subdivided not only into two regions as in FIG. 10, but also into arbitrarily several regions, depending on the scale and the detection speed of the current detection circuits.

As described above, in the first aspect of the present invention, the value of the light-emission drive current flowing for causing each light-emission element bearing each pixel to independently emit light in succession is measured, then the luminance is corrected for each input pixel data by means of the above light-emission drive current values, associated with the pixels corresponding to the input pixel data.

Thus, according to the first aspect of the present invention, a display of high quality images without luminance irregularity is made possible even if luminance variance occurs in each of the EL elements corresponding to each pixel as a consequence of driving the display panel for a prolonged time.

Other embodiments of the present invention will be described below in detail with reference to the accompanying drawings.

Figure 11:
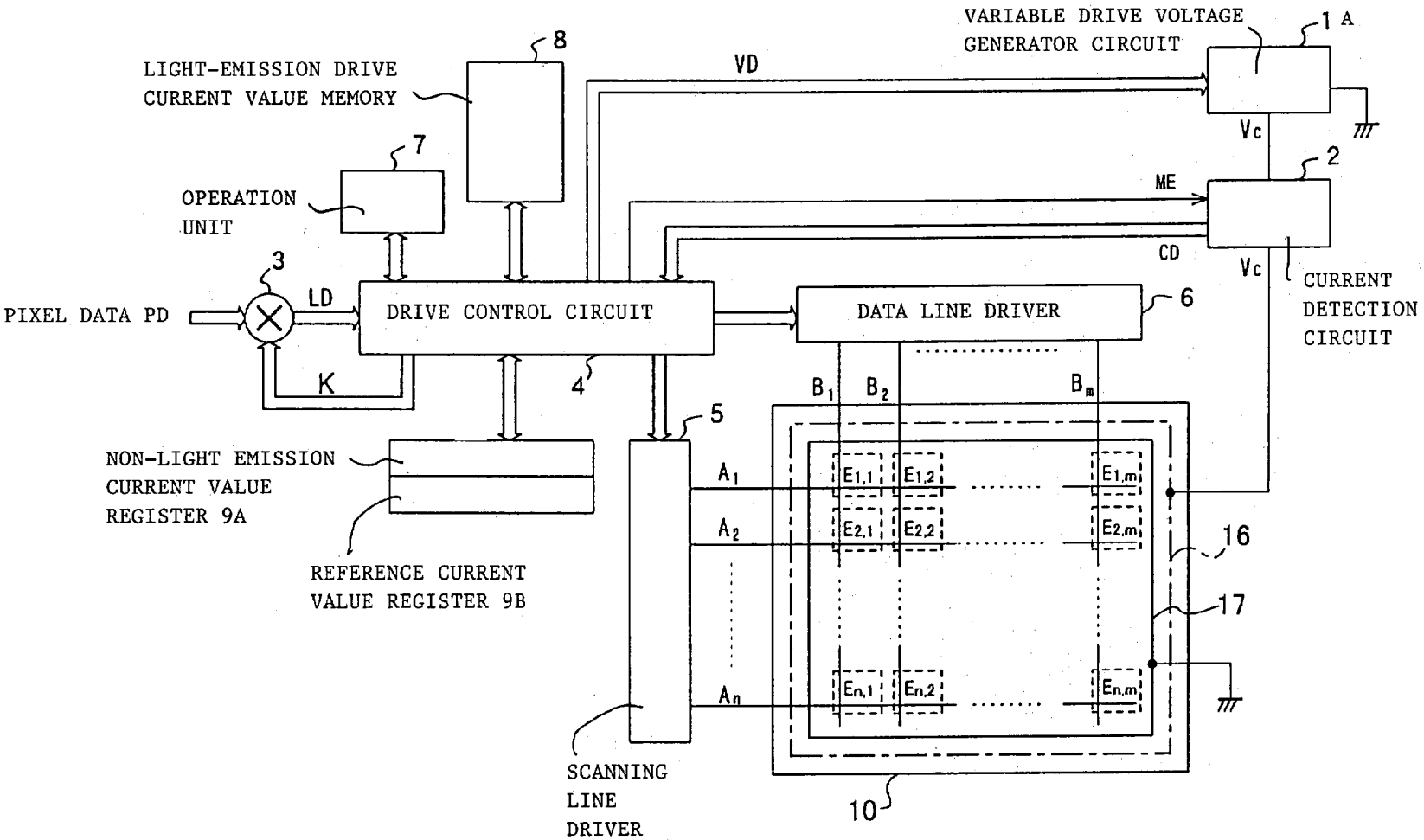
FIG. 11 is a schematic diagram showing the structure of another active matrix drive type EL display device according to the present invention.

FIG. 11 is a schematic diagram showing another constitution an electroluminiscent display device (hereinafter referred to as an EL display device) using the display panel driving method according to the present invention for the display of images.

The EL display device shown in FIG. 11 is identical to the device shown in FIG. 3, with the difference that instead of the drive voltage generator circuit 1, a variable drive generator circuit 1A is used here.

The variable drive voltage generator circuit 1A generates a DC drive voltage Vc above having a voltage value specified by a drive voltage specification signal VD supplied by the drive control circuit 4, and applies it to the anode line 16 of the display panel 10.

Figure 12:
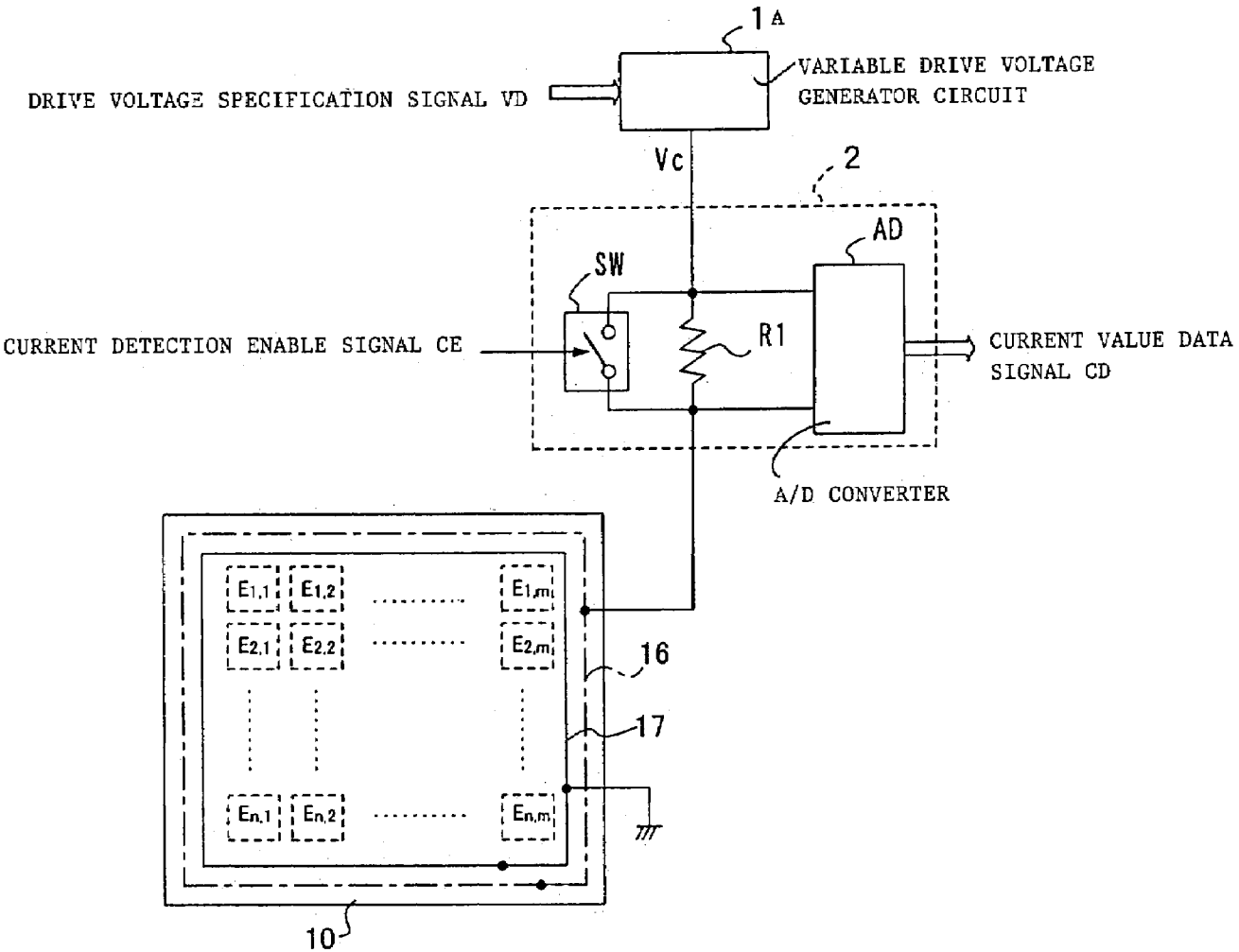
FIG. 12 is a schematic diagram showing an embodiment of the inner structure of the current detection circuit 2.

The current detection circuit 2 detects the current flowing to the anode power line 16, and supplies the current value data signal CD indicating the value of the detected current to the drive control circuit 4. The current detection circuit 2, as shown for instance in FIG. 12, comprises as in FIG. 4 a resistor R1 connected between the variable drive voltage generator circuit 1 and the anode power line 16 of the display panel 10, a measuring switch SW and an A/D converter AD, so their operation is will not be explained here again.

The drive control circuit 4 carries out the gradation display by means of, for instance, the sub-field method shown in FIG. 5, then, after executing the light-emission drive measurement routine shown in FIG. 6, the drive control circuit 4 moves on to execute the drive voltage setting routine described in FIG. 7.

Figure 13:
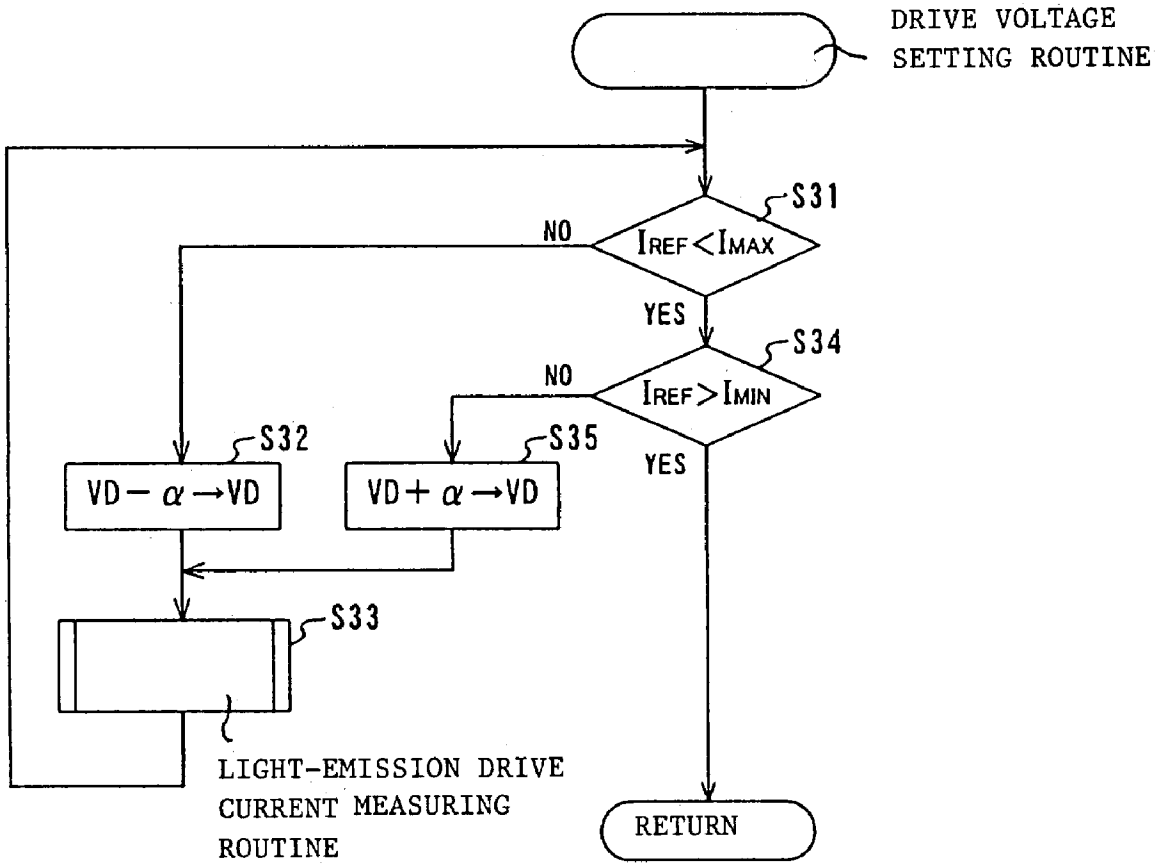
FIG. 13 is a flowchart describing the drive voltage setting routine executed by the drive control circuit 4.

In FIG. 13, firstly the drive control circuit 4 checks whether the reference current value $I_{REF}$ stored in the reference current value register 9B above is smaller than the predetermined upper-limit current value $I_{MAX}$ (step S31). The upper-limit current value $I_{MAX}$ is the upper-limit value of the range of light-emission drive currents causing the EL elements 15 to emit, a range that ensures a required minimum luminance while not exceeding a predetermined value of consumed power. In the above step S31, if the reference current value $I_{REF}$ is verified be not smaller than the upper-limit current value $I_{MAX}$, the drive control circuit 4 assigns the result of subtracting a prescribed voltage value á from the voltage value specified by the immediately preceding drive voltage specification signal VD above as the new specified voltage value of the drive voltage specification voltage VD, which it then supplies to the variable drive voltage generator circuit 1 (step S32). By performing step S32, the variable drive voltage generator circuit 1 supplies a drive voltage Vc decreased only by a portion corresponding to the specified voltage value á to the anode power line 16. Next, the drive control circuit 4 executes again the light-emission drive current measurement routine described in FIG. 6 (step S33). That is, in step S32, the measurement of the light-emission drive current for each of the EL elements 15 within the EL units E1,1 to En,m is carried out again in the state result of subtracting only the portion corresponding to the specified voltage value á from the drive voltage Vc applied to the anode power line 16. After completing the above step S33, the drive control circuit 4 returns to perform the step S31 above and repeats the procedure described therein. That is, the drive control circuit 4 goes on decreasing the voltage drive Vc to be applied to the anode power line 16 by the specified voltage value á until the reference current value $I_{REF}$ becomes smaller than the upper-limit current value $I_{MAX}$.

In the step S31 above, if the reference current value $I_{REF}$ is verified to be smaller than the upper-limit current value $I_{MAX}$, the drive control circuit 4 checks next whether the reference current value $I_{REF}$ is greater than a specified lower-limit current value $I_{MIN}$ (step S34). The lower-limit current value $I_{MIN}$ is the lowest light-emission drive current value for causing the EL elements 15 to emit light with the required minimum luminance. In the above step S34, if the reference current value $I_{REF}$ is checked to be not larger than the lower-limit current value $I_{MIN}$, the drive control circuit 4 assigns the result of adding the prescribed voltage value á to the voltage value specified by the immediately preceding drive voltage specification signal VD as the new specified voltage value of the drive voltage specification voltage VD, which it then supplies to the variable drive voltage generator circuit 1 (step S35). By performing step S35, the variable drive voltage generator circuit 1 supplies the drive voltage Vc increased only by a portion corresponding to the specified voltage value á to the anode power line 16. After completing the step S35, the drive control circuit 4 goes on to execute again the light-emission drive current measurement routine of step S33. That is, the measurement of the light-emission drive current for each of the EL elements 15 within the EL units $E_{1,1}$ to $E_{n,m}$ is carried out again in the state result of adding only the portion corresponding to the specified voltage value á to the drive voltage Vc applied to the anode power line 16. After completing the above step S33, the drive control circuit 4 returns to perform the step S31 above and repeats the procedure described therein. That is, the drive control circuit 4 goes on increasing the voltage drive Vc to be applied to the anode power line 16 by the specified voltage value á until the reference current value $I_{REF}$ becomes larger than the lower-limit current value $I_{MIN}$.

In the step S34 above, when the reference current value $I_{REF}$ is verified to be larger than the lower-limit current value $I_{MIN}$, the reference current value $I_{REF}$ is kept within the range defined by the lower-limit current value $I_{MIN}$ and the upper-limit current value $I_{MAX}$, then the drive control circuit 4 exits the drive voltage setting routine and returns to execute the main routine (not shown in the drawings).

Thus, by executing the above drive current voltage setting routine, the drive voltage Vc is adjusted in such a manner that the smallest light-emission drive current value among the light-emission currents flowing to each EL element 15 within the EL units $E_{1,1}$ to $E_{n,m}$ becomes the light-emission drive current value required for causing the EL element 15 to emit light within the desired luminance range.

Therefore, even if variations in the internal resistance value of the EL elements 15 occur as a consequence of, for instance, variance during manufacturing, changes in the environmental temperature or because of the accumulated light-emission life, etc., the luminance level across the entire screen of the display panel 10 can be kept within a desired luminance range.

Also, in the above embodiment, the current detection circuit 2 actually detecting the light-emission drive current is provided between the variable drive voltage generator circuit 1A and the anode power line 16, but if the variable drive voltage generator circuit 1 comprises a plurality of independent variable drive voltage generator circuits, as shown in FIG. 9, a current detection circuit can also be provided for each of the variable drive voltage generator circuits.

Also, a drive voltage generator circuit 1*a* for display in a first region and a drive voltage generator circuit 1*b* for display in a second region, as in FIG. 10, can be independently provided as well as the variable drive voltage generator circuit 1A shown in FIG. 11.

Further, in the above embodiment, the drive voltage setting routine described in FIG. 13 is executed after the execution of the light-emission drive current measurement routine described in FIG. 6, but it can also be executed repeatedly at regular intervals.

Also, in the drive current measurement routine above, the adjustment of the drive voltage Vc is carried out in such a manner that the smallest measured current value among the current values measured from each EL element 15 in the EL units $E_{1,1}$ to $E_{n,m}$ stays within the range defined by the lower-limit current value $I_{MIN}$ and the upper-limit current value $I_{MAX}$. However, it is also possible to carry out the adjustment of the drive voltage Vc in such a manner that the average value of each of these measured current values stays within a predetermined range defined by the lower-limit current value $I_{MIN}$ and the upper-limit current value $I_{MAX}$. In this case, the drive control circuit 4 determines the average value of the measured current values for each pixel stored in the light-emission drive current value memory 8, and carries out the actions of steps S31 to S35 in FIG. 7 with that value as the reference current value $I_{REF}$.

In the present invention, if necessary, the drive voltage Vc can be adjusted in such a manner that the smallest measured current value among each of the EL units $E_{1,1}$ to $E_{n,m}$, or the average value of each measured current is equal to a predetermined reference current value (ranging from the lower-limit current value $I_{MIN}$ to the upper-limit current value $I_{MAX}$).

Figure 1:
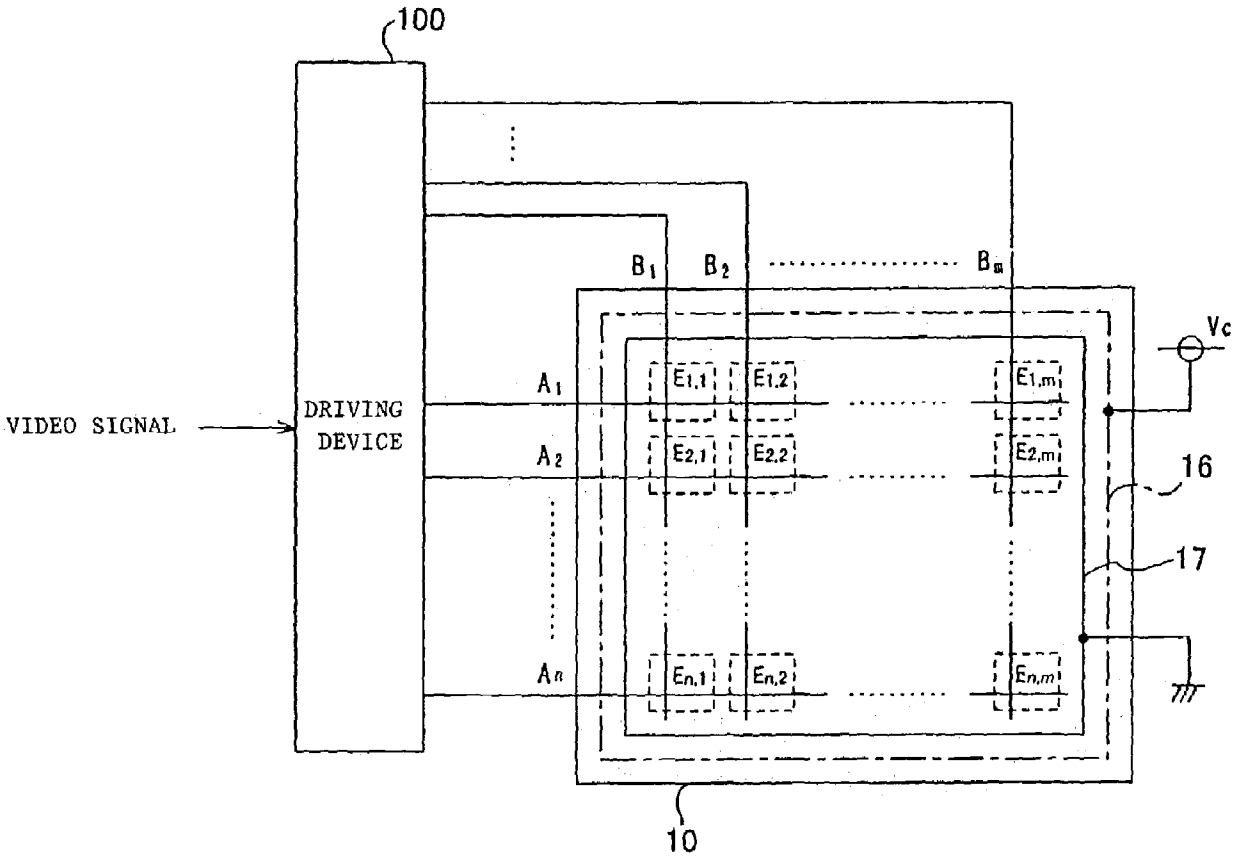
FIG. 1 is a schematic diagram showing the constitution of an active matrix drive type EL display device.
Figure 2:
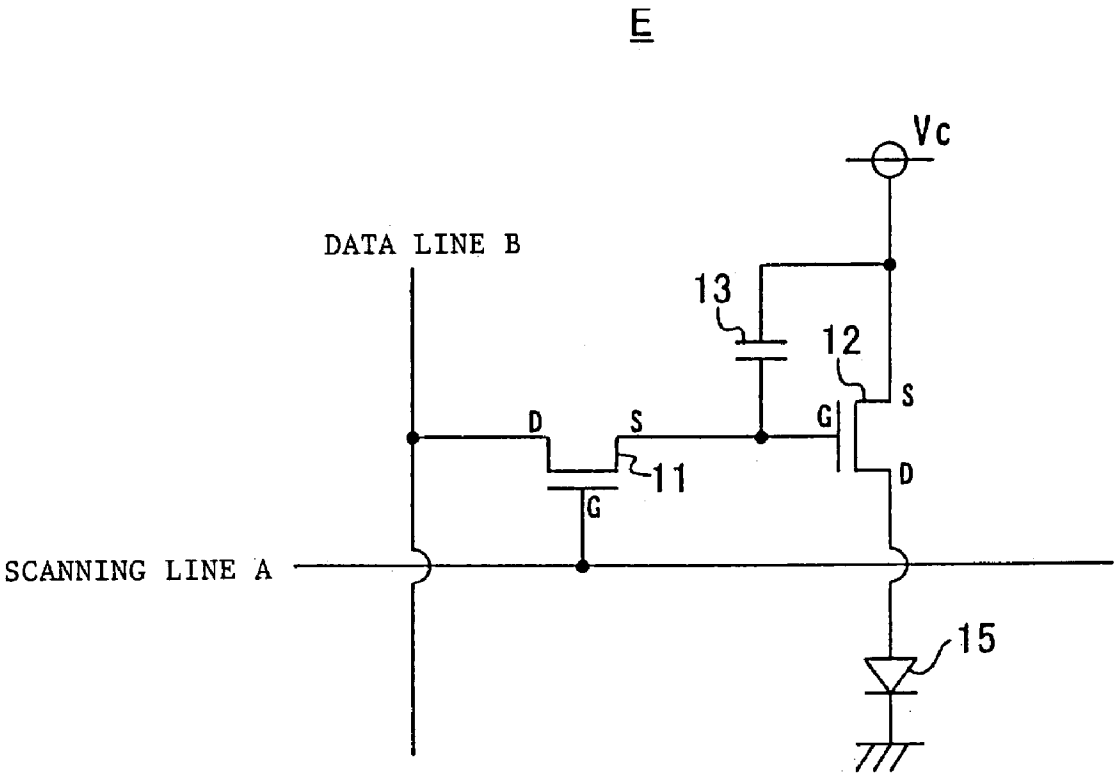
FIG. 2 is a diagram showing an example of the inner structure of an EL unit E bearing each pixel.
Figure 14:
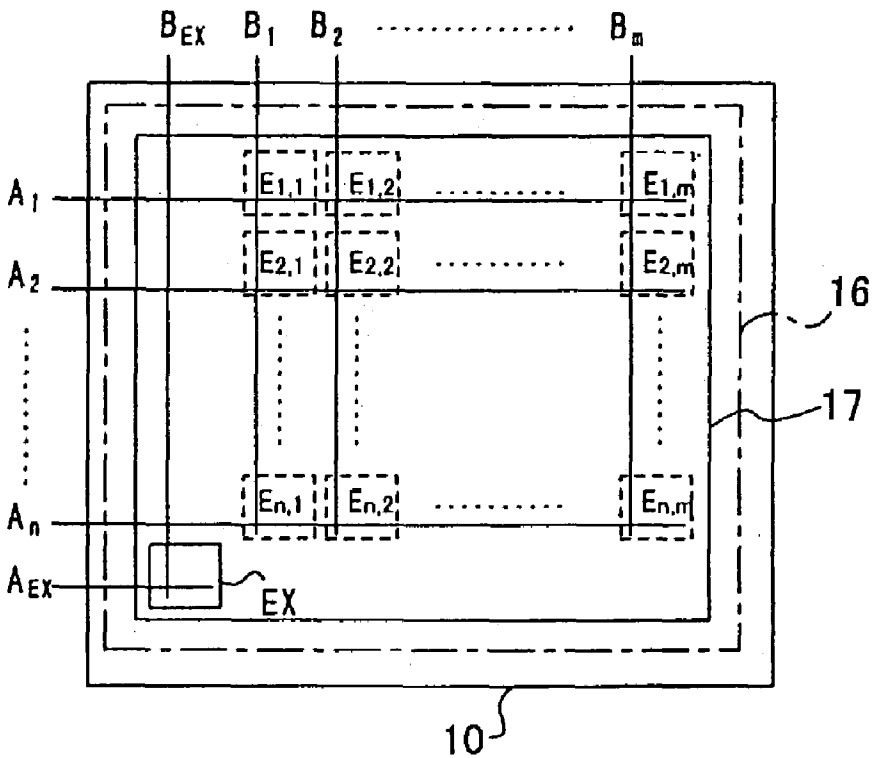
FIG. 14 is a diagram showing an embodiment of the display panel 10 having an EL unit EX for obtaining the reference current value $I_{REF}$.

In setting the above reference current value $I_{REF}$, the average value of the light-emission current values measured for a specific plurality of EL elements 15 within all the EL units E that form the display panel 10 can also be taken as the reference current value $I_{REF}$. Further, the reference current value $I_{REF}$ can also be the light-emission current value measured as is for an EL element 15 in one specific EL unit E in the display panel 10. Further, this specific EL unit can be one among the EL units $E_{1,1}$ to $E_{n,m}$, or it can also be an EL unit EX (with the internal constitution shown in FIG. 2 provided specially for obtaining the reference current value $I_{REF}$, as depicted in FIG. 14. In this case, the EL unit EX receives the drive voltage supply through the anode power line 16 just like the EL units $E_{1,1}$ to $E_{n,m}$. For obtaining the light-emission drive current value of the EL unit EX as the reference current value $I_{REF}$, the drive control circuit 4 supplies a current measurement signal to the data line driver 6 and the scanning line driver 5. In response to this current measurement signal, the data line driver 6 applies a pixel data pulse to the above EL unit EX through data line $B_{EX}$, and the scanning line driver 5 applies a scanning pulse to the EL unit EX through scanning line $A_{EX}$. Thereby, a light-emission drive current flows to the EL element 15 in the EL unit EX in order for it to emit light, and a light-emission drive current flows to the anode power line 16. Now, the current detection circuit 2, detects the light-emission drive current that has flowed to the anode power line 16 and supplies the current value data signal CD indicating that current value to the drive control circuit 4. The drive control circuit 4, fetches the current value indicated by the current value data signal CD and stores it in the reference current value register 9B as the reference current value $I_{REF}$.

Thus, as described above in the second and third aspects of the present invention, each light-emission drive value of current flowing in succession to each light-emission element bearing each pixel for causing the latter to emit light individually is measured for each pixel [for further use]. The luminance correction for the input pixel data is carried out based on the light-emission drive current value associated with the pixels the in accordance with the input pixel data, and the voltage value of the drive voltage supplied to each emitting element is adjusted in such a manner that one value among each of the measured light-emission drive currents values becomes equal to a predetermined reference current value.

Thus, by means of the second and third aspects of the present invention, it is possible to prevent the occurrence of luminance irregularity in the screen and to keep at all times the luminance level within a specific range for the whole screen.

Further embodiment of the present invention will explained with reference to the accompanying drawings.

Figure 15:
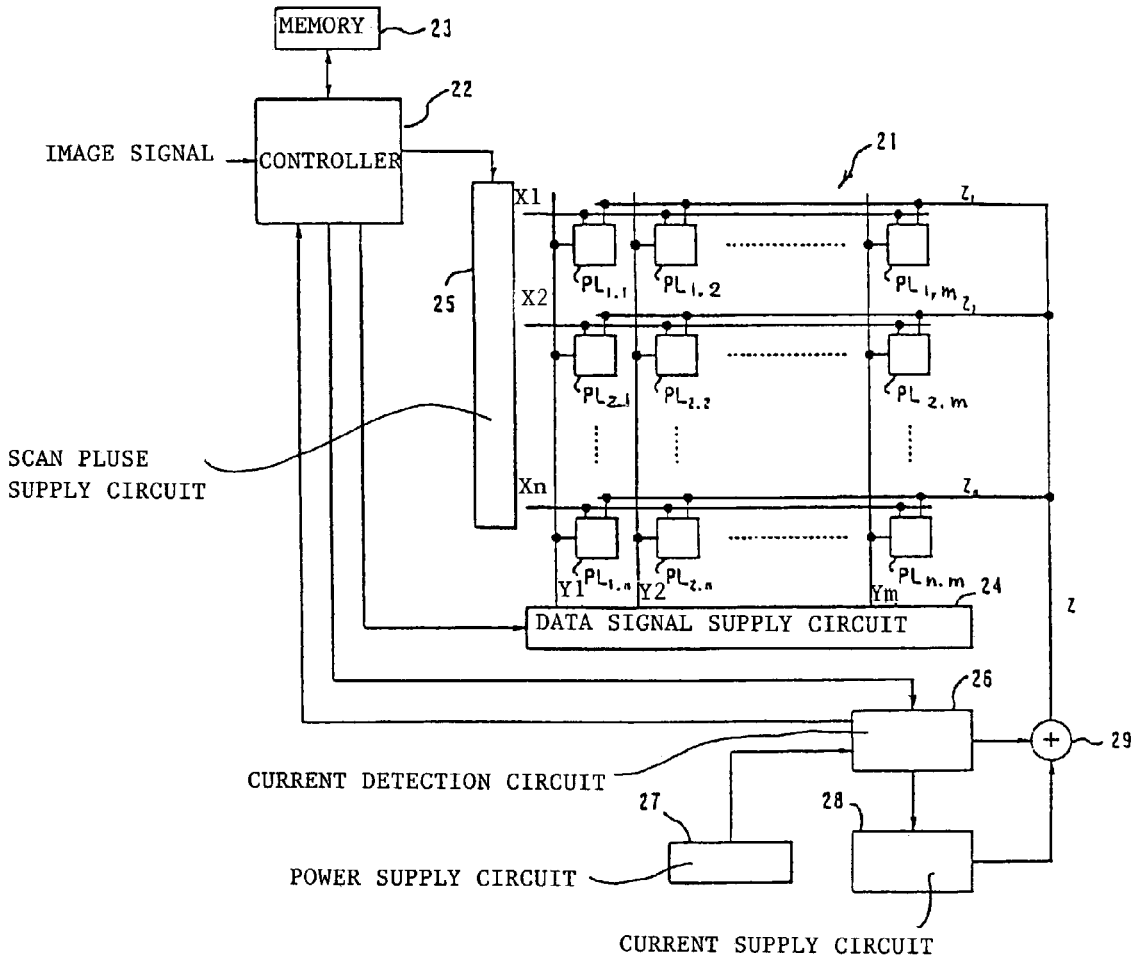
FIG. 15 is a diagram showing the structure of the display apparatus in which the present application is embodied.

FIG. 15 shows a display apparatus as a further embodiment of the present invention. The display apparatus is comprised of elements which include: a display panel 21; a controller 22; a pixel current value memory 23; a data signal supply circuit 24; a scan pulse supply circuit 25; a current detection circuit 26; a power supply circuit 27; a current supply circuit 28; and a current summing circuit 29.

The display panel 21 includes a plurality of data lines $Y_1$ to $Y_m$ (m is an integer greater than one) and a plurality of scan lines $X_1$ to $X_n$ (n is an integer greater than one), and a plurality of power supply lines Z1 through Zn. As shown in FIG. 15, the plurality of scan lines $X_1$ to $X_n$ and the plurality of power supply lines Z1 to Zn are arranged in parallel with each other. The plurality of data lines $Y_1$ to $Y_m$ are arranged to cross each of the plurality of scan lines $X_1$ to $X_n$ and the plurality of power supply lines Z1 to Zn. Each of the pixel portions $PL_{1,1}$ to $PL_{n,m}$ is arranged at respective one of intersecting points between the plurality of data lines $Y_1$ to $Y_m$ and the plurality of scan lines $X_1$ to $X_n$, thereby forming a matrix type display panel. The power supply lines Z1 to Zn are mutually connected to form a single power supply line Z, which is in turn connected to the current summing circuit 29. Each of the plurality of pixel portions $PL_{1,1}$ to $PL_{n,m}$ has the configuration shown in FIG. 2.

The display panel 21 is connected to the scan pulse supply circuit 25 via the scan lines $X_1$ to $X_n$, and also to the data signal supply circuit 24 via the data lines $Y_1$ to $Y_m$. The controller 22 generates a scanning control signal and a data control signal in order to drive the display panel under a gray scale drive control in accordance with the incoming image signal. The scanning control signal is applied to the scan pulse generator circuit 25, and the data control signal is applied to the data signal supply circuit 24.

The scan pulse supply circuit 25 is connected to the scan lines $X_1$ to $X_n$, and supplies a scan pulse to the scan lines $X_1$ to $X_n$ in a predetermined order in accordance with a scanning control signal.

The data signal supply circuit 24 is connected to the data lines $Y_1$ to $Y_m$, and supplies a pixel data pulse, via the data line, to the pixel portions to be driven to the light emission state among the pixel portions located on a scan line to which the scan pulse is supplied.

The gray-scale driving scheme of the display panel 21 is the same as that described with reference to FIG. 2, and the explanation will not be repeated.

When the display panel is driven by using three subframes as shown in FIG. 4, half tone of eight gray-scale levels can be displayed with different combinations of the three subframes.

In the pixel memory 23, pixel current values respectively for the pixel portions $PL_{1,1}$ to $PL_{n,m}$ are written as data by the controller. The writing operations of this process will be described below.

The current detection circuit 26 detects thee value of the value of the current outputted from the power supply circuit 27 to the power supply line Z. The current supply circuit 28 sets an offset current value in accordance with the current value detected by the current detection circuit 26, and supplies an offset value for the detected current value to the current summing circuit 29.

Figure 16:
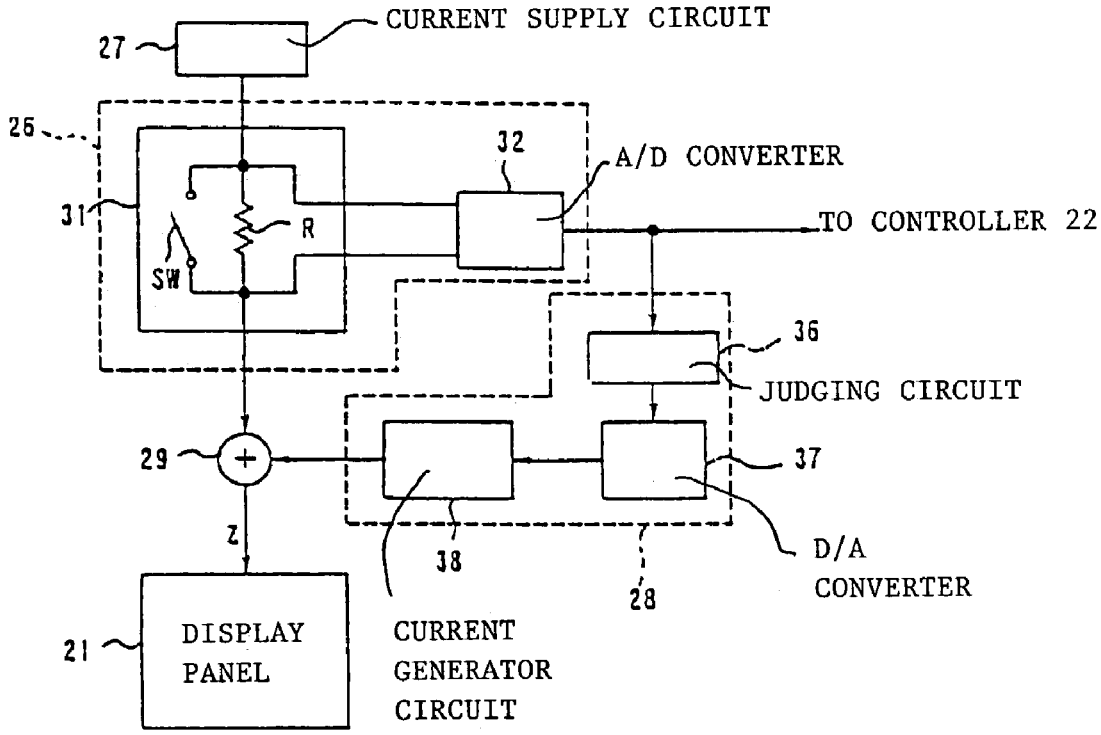
FIG. 16 is a diagram showing the structure of the current detection circuit and the current supply circuit in the apparatus shown in FIG. 15.

As shown in FIG. 16, the current detection circuit 26 comprises a current measuring circuit 31, and an A/D converter 32. The current supply circuit 28 comprises a judging circuit 36, a D/A converter 37 and a current generator circuit 38, also as shown in FIG. 16.

The current measuring circuit 31 is interposed between the power supply circuit 27 and the current summing circuit 29. The current measuring circuit 31 has a resistor R and a switch SW which are connected in parallel, so that the current from the power supply circuit 27 is supplied to the power supply circuit via the switch SW when the switch SW is turned on or via the resistor R when the switch SW is turned off. The on-off state of the switch SW is controlled by the controller 22. The current measuring circuit 31 outputs a voltage corresponding to the value of the current flowing through the resistor R, that is, the voltage across the terminals of the resistor R.

The A/D converter 32 converts the output voltage of the current measuring circuit 31 into a digital signal, and supplies the digital signal to the controller 22 and the judging circuit 36. The judging circuit 36 judges as to whether or not the leak current value indicated by the digital signal outputted from the A/D converter 32 is a current value within a predetermined range. Additionally, the judging circuit 36 sets an offset current value in accordance with the result of the judgment. The offset current value designated by the judging circuit 36 is outputted to the D/A converter 37 in the form of a digital signal. The D/A converter 37 converts the digital signal to a voltage signal in analog form, and supplies the analog signal to the current generator circuit 38. The output voltage of the D/A converter 37 is controlled by an instruction from the controller 22. The current generator circuit 38, which is a V/I converting circuit that converts the voltage signal to a current, consequently outputs the offset current having a value designated by the judging circuit 36.

The current summing circuit 29 adds the current outputted by the current measuring circuit 31 and the current generator circuit 38, and supplies the summed value to the power supply lines Z1 to Zn.

The controller 22 executes a leak current cancelling routine and a light-emission drive current measuring routine. The leak current cancelling routine is a routine for measuring, as a leak current, the current flowing in the display panel 21 when the light-emission drive is ceased in all of the pixel portions $PL_{1,1}$ to PL m,n, and for driving the current generator circuit 38 to output a current corresponding to the leak current. The light-emission drive current measuring routine is a routine for measuring the drive current of each of the pixel portions $PL_{1,1}$ to $PL_{n,m}$. Although the timings of execution of these routines need not be set at any particular time points, it can be executed, for example, when the power supply of the display apparatus is turned off, when the image data is not input, or in intervals of between one subfield and a next subfield.

Figure 17:
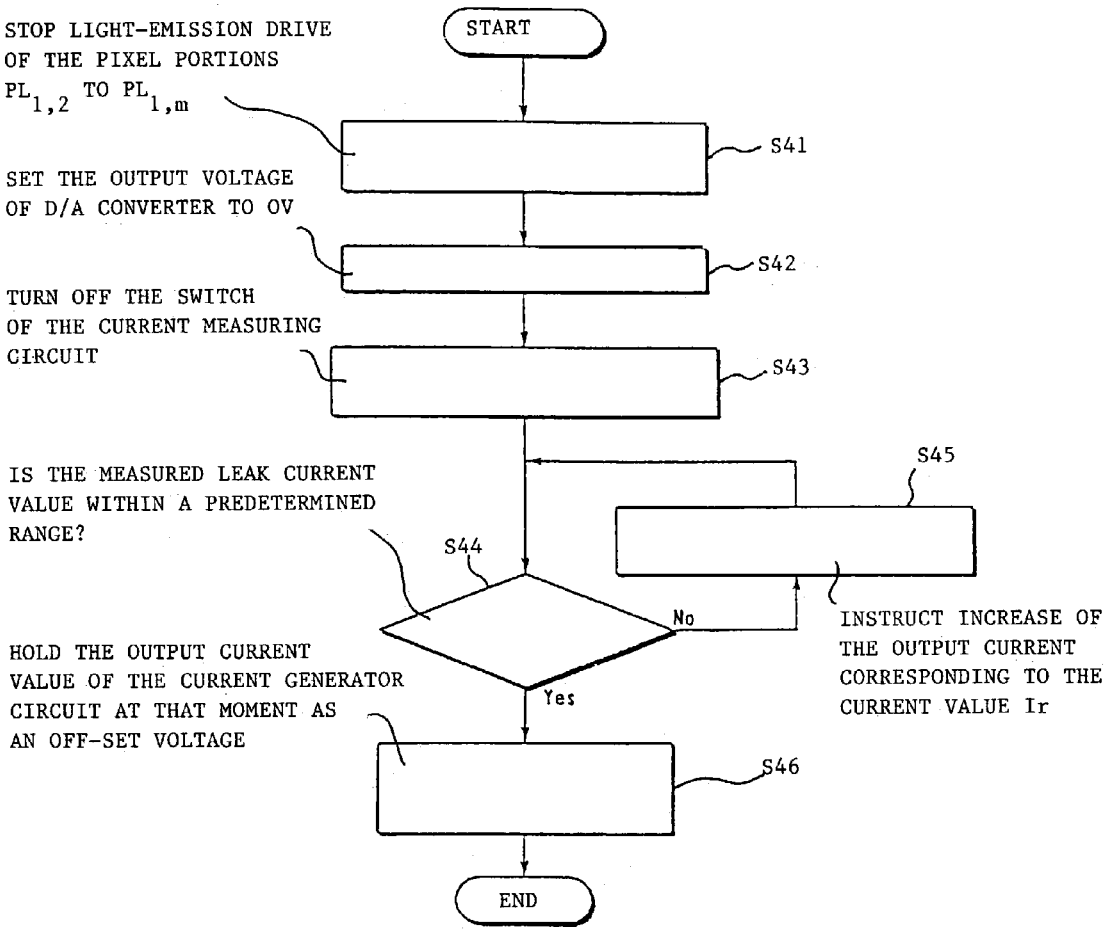
FIG. 17 is a flowchart showing a leak current cancelling routine.

In the leak current cancelling routine, as shown in FIG. 17, the controller 22 places the display panel in a state that the light-emission driving is halted in all of the pixel portions $PL_{1,1}$ to $PL_{n,m}$ of the display panel 21 (step S41). Specifically, the controller 22 stops generation of the scanning control signal and data control signal mentioned before. Then, the controller 22 sets the output voltage of the D/A converter 37 at 0V so that the offset current value becomes equal to zero (step S42). When the output voltage of the D/A converter 37 is 0V, the output of the offset current from the current generator circuit 38 becomes turned off accordingly. Furthermore, the controller 22 set the switch of the current measuring circuit 31 at the off position (step S43).

In this control state, the output voltage (power supply voltage) Vc of the power supply circuit 27 is applied between the power supply liens Z1 to Zn and the ground line of the display panel 21 via the resistor R of the current measuring circuit 31 and the current summing circuit 29, so that the leak current flows in the display panel 21. The output voltage of the current measuring circuit 31 is converted to a digital value at the A/D converter 32, and supplied to the judging circuit 36. The controller 22 drives the judging circuit 36 to make judgement as to whether or not the leak current value indicated by the digital signal outputted from the A/D converter 32 is within a predetermined range (step S44). As a result of the judgement by the judging circuit 36, if the leak current value is higher than the predetermined range, a digital signal corresponding to the increase of current equal to the predetermined current value Ir is outputted to the A/D converter 37 (step S45). The digital signal may be supplied to the D/A converter 37 either one of the controller 22 and the judging circuit 36. The D/A converter 37 converts the supplied digital signal to an analog signal, and supplies the analog signal to the current generator circuit 38. The current generator circuit 38 increases the current value by the predetermined current value Ir, and outputs the increased current. The output current of the current generator circuit 38 is supplied to the current summing circuit 29. By means of the output current of the current generator circuit 38, the current outputted from the power supply circuit is decreased by the current value Ir. That is, the value of the current flowing from the current summing circuit 29 to the display panel 21 itself is maintained unchanged.

When the measured leak current is judged by the judging circuit 36 to be within the predetermined range, the controller 22 makes the output current value of the current generator circuit 38 at that time to be held as an offset current value (Step S46).

Figure 18:
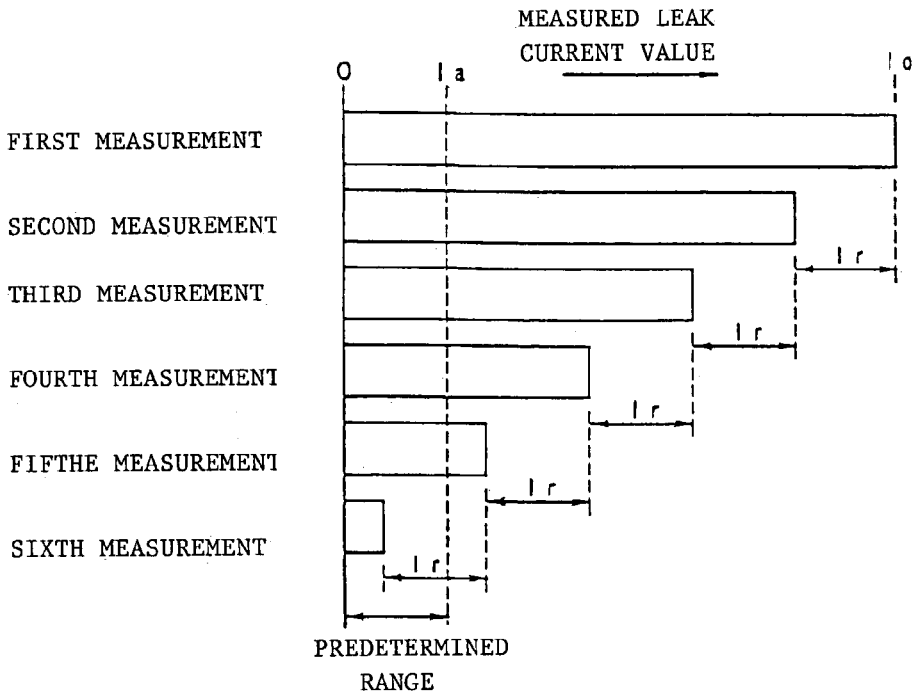
FIG. 18 is a diagram showing an example of the leak current canceling process.

FIG. 18 shows the manner of the change of the measured leak current until it reaches to a current value within the predetermined range. The leak current value measured at first time is the value of the actual leak current flowing in the display panel 21. At the first time, no current is outputted from the current generator circuit 38. The leak current value of the second time is a value decreased from the actual leak current value by the current value Ir. In the second time, the output current value of the current generator circuit 38 becomes equal to Ir. In this way, the leak current value in the j-th time is a value decreased from the actual leak current Io by the current value (j−1)Ir. The judging circuit 36 judges as to whether or not the current value satisfies the condition of $0 \leqq Io-(j-1)Ir \leqq Ia$, where 0 and Ia is the end values of the predetermined range of the current value 0 to Ia.

In FIG. 18, the sixth measured leak current value is a value decreased from the actual leak current value by the current value 5Ir, and is expressed as Io−5Ir. In the sixth measurement, the output current value of the current generator circuit 38 is 5Ir. The sixth measured leak current value is in a predetermined current range 0 to Ia. The output current value of the current generator circuit 38 is held as an offset current.

Figure 19:
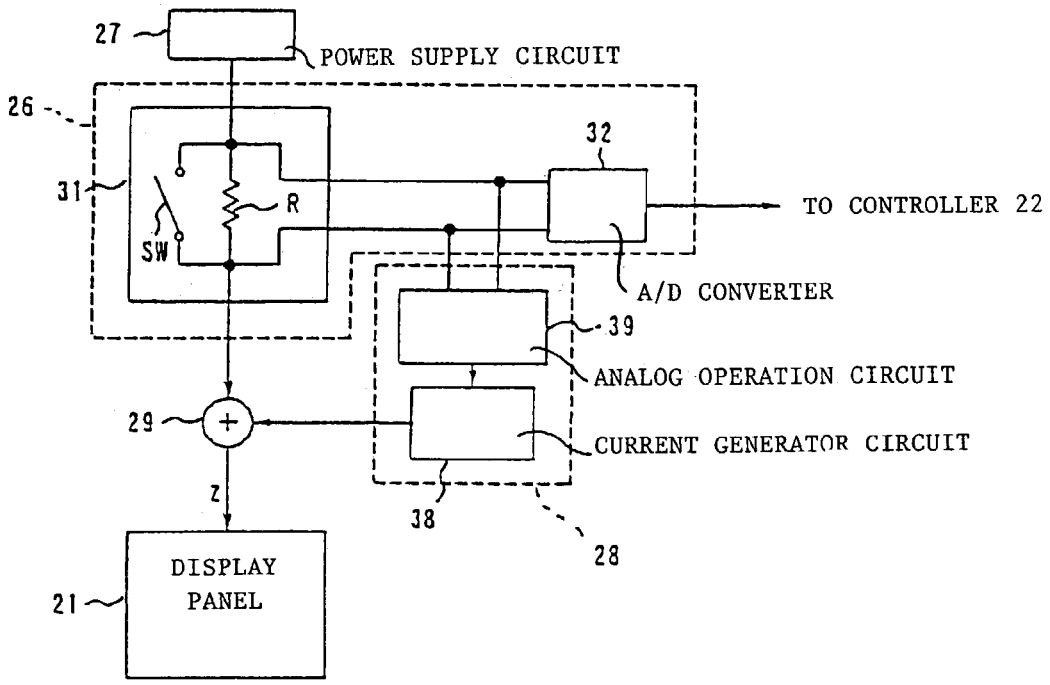
FIG. 19 is a diagram showing another example of the structure of the current detection circuit and the current supply circuit in the apparatus shown in FIG. 15.

As shown in FIG. 19, the current supply circuit 28 can be constituted by an analog operation circuit 39 and a current generator circuit 38. The analog operation circuit 39 calculates a voltage level supplied to the current generator circuit 38 in accordance with a voltage that indicates the leak current value outputted by the current measuring circuit 31. In short, the analog operation circuit 39 drives the current generator circuit 38 to output the current (j−1)Ir so as to satisfy the condition:

$$0 \leqq Io-(j-1)Ir \leqq Ia.$$

Figure 20:
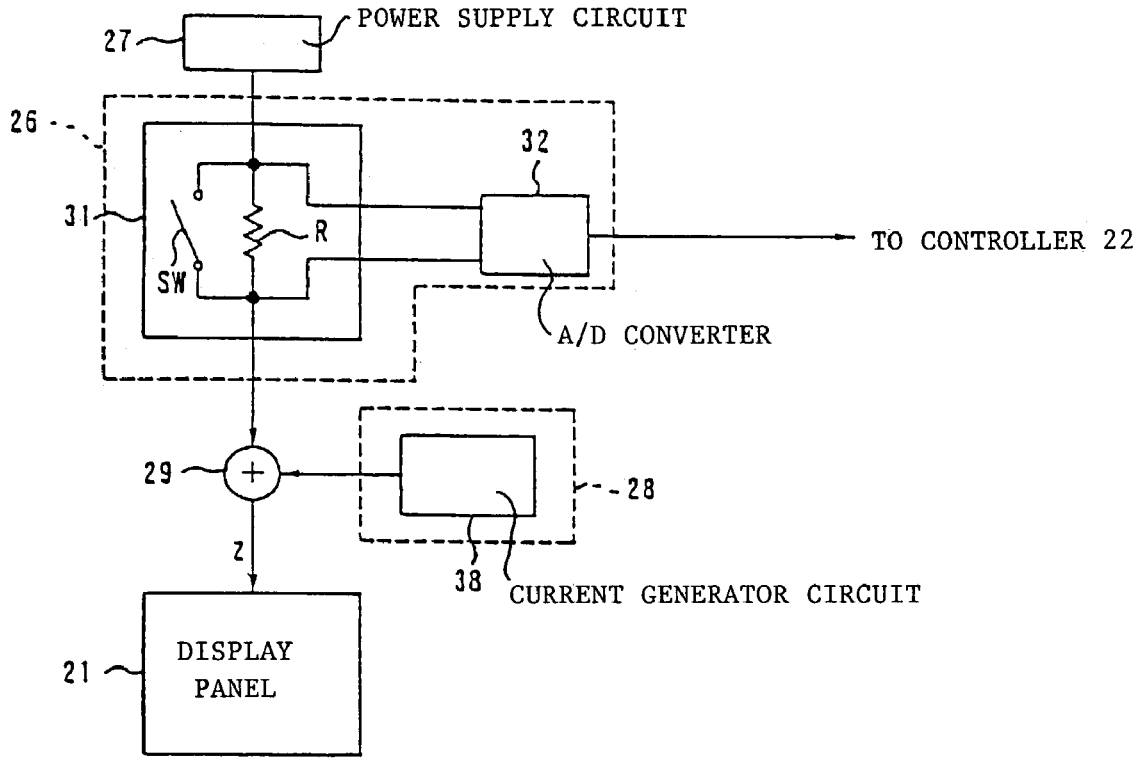
FIG. 20 is a diagram showing a further example of the structure of the current detection circuit and the current supply circuit in the apparatus shown in FIG. 15.

As shown in FIG. 20, the current supply circuit 28 may be constituted solely by the current generator circuit 38. In the current supply circuit 38 in FIG. 20, its output current value is made adjustable by a manual operation. With this feature, the output current of the current generator circuit 38 is manually adjusted so that the measured leak current value outputted from the current measuring circuit 31 becomes a current value within the predetermined range 0 to Ia.

Furthermore, in each of the embodiment shown in FIGS. 16, 19 and 20, explanation has been made for a case in which light of the same color is emitted by the EL element, that constitutes the light-emission element of the pixel portions $PL_{1,1}$ to $PL_{n,m}$ of the display panel. In the case where a plurality of colors like RGB (Red Green and Blue) are to be generated by light-emission, the drive voltate VC may be different for each light-emission color. In that case, the power supply circuit 27, the current detection circuit 26, and the current supply circuit 28 may be provided for each of pixel portions respectively having different light-emission colors.

After the output current of the current supply circuit 28 has been held as the offset current vale in the leack current canceling routine described above, the controller 22 executes the light-emission driving current measuring routine for each of the pixel portions $PL_{1,1}$ to $PL_{n,m}$.

Figure 21:
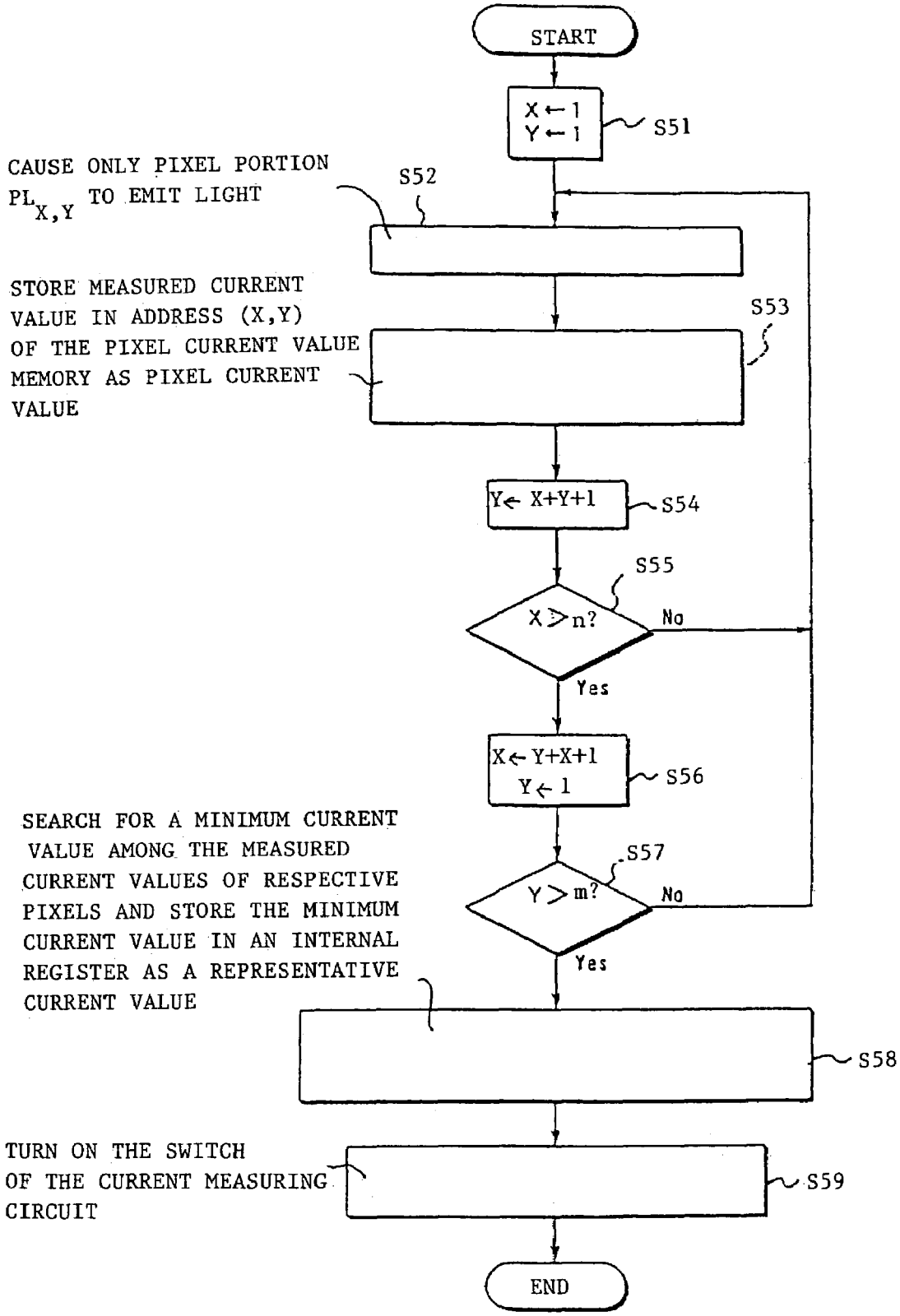
FIG. 21 is a flowchart showing the light-emission driving current measuring routine.

As shown in FIG. 21, the controller 22 first stores "1" in the row number resistor X (not shown) as an initial row number, and stores "1" in the column number resistor Y (not shown) as an initial column number (step S51). Subsequently, the controller 22 supplies to the scan pulse supply circuit 25 and the data signal supply circuit 24 a drive control signal for causing light-emission driving only in a pixel portion $PL_{X,Y}$ among the pixel portions $PL_{1,1}$ to $PL_{n,m}$ that corresponds to the row number stored in the row number register X and the column number stored in the column number register Y (step S52). As a result of execution of the step S52, the scan pulse supply circuit 25 supplies the scan pulse only to the scan line $X_X$ among the scan lines $X_1$ to $X_n$, which is indicated by the row number stored in the row number register X. At the same time, the data signal supply circuit 24 supplies a data signal of a low level (for instance, a ground potential) only to the data line $Y_Y$ indicated by the column number stored in the column number register, among the data lines $Y_1$ to $Y_m$, while supplying a potential of a high voltage to the remaining data lines excluding the data line $Y_Y$. By the processing operations described above, the light-emission drive current flows only through the EL element in the pixel portion $PL_{X,Y}$ from among the pixel portions $PL_{1,1}$ to $PL_{n,m}$, so that this EL element emits light. Accordingly, only the light-emission drive current consumed by the EL element within the pixel portion $PL_{X,Y}$ flows through the power supply lines $Z_Y$ and Z. The current detection circuit 26 supplies a current value data signal CD representing the value of current flowing through the power supply line Z, to the controller 22.

In this process, the controller 22 takes the current value indicated by the above-described current value data signal CD therein, and stores it in the pixel current value memory 23, at an address [X,Y] (step S53). Then, the controller 22 increments the column number stored in the column number register Y by one (step S54). Subsequently, the controller 22 judges as to whether or not the column number stored in the column number register Y is greater than the last column number m (Step S55). If it is judged in step S55 that the column number stored in the column number register Y is not greater than the last column number m, the controller 22 returns to the execution of the step S52 described above, to repeatedly perform the operations described above.

By the repeated executions of the steps S52 to S55 described above, the light-emission drive current flowing through the EL element in each of the pixel portions $PL_{1,y}$ to $PL_{n,y}$ positioned on the scanning line $X_Y$ indicated by the row number stored in the row number register X is respectively measured in sequence, and stored in the light-emission driving current memory 8.

In step S55, if it is detected by the controller 22 that the column number stored in the column number register Y is greater than the last column number m, the row number stored in the row number register X is incremented by one, and the column number stored in the column number register Y is rewritten to 1 (step S56). Briefly speaking, by the execution of the step S56, the pixel portion serving as a target of the measurement of the light-emission driving current is moved from the scanning line $X_X$ to the pixel portion on the next scanning line $X_{X+1}$. The controller 22 also performs a judgment as to whether or not the row number stored in the row number register X is greater than the last row number n (step S57). If it is judged in step S17 that the row number stored in the row number register X is not greater than the last row number n, the controller 22 returns to the execution of the step S52 to repeat the operations described above.

By the repeated executions of the steps S52 to S57, the light-emission driving current is measured for all of the EL elements in the pixel portions $PL_{1,1}$ to $PL_{n,m}$ formed in the display panel 21, and the results of the measurement are stored in the pixel current value memory 23 respectively correspondingly to the pixels.

If it is judged in the step S57 described above that the row number stored in the row number register X is greater than the last row number n, the controller 22 searches for the lowest one of the respective pixel current values of the pixels stored in the pixel current memory 23 mentioned above, and stores the searched out current value in the internal register (not shown) as a representative current value (step S58). Then, the controller 22 performs a control operation to turn on the switch SW in the current measuring circuit 31 (step S59).

By this operation, a short-circuit occurs across the terminals of the register R provided in the current measuring circuit 31, so that the drive voltage Vc generated by the power supply circuit 27 is directly applied to the power supply line Z. After the execution of the step S59, the controller 22 exits from this light-emission driving current measuring routine, and returns to the execution of the main routine (not shown).

As described above, the light-emission driving current measuring routine is executed in response to such an operation as the switch-off operation by the user to stop displaying images by the display panel 21. In other words, the measurement is performed on the light-emission driving current flowing in the case that each one of the EL elements in the pixel portions $PL_{1,1}$ to $PL_{n,m}$ is driven solely to emit light, within a period in which the display operation based on the image data is not performed. The results of the measurement are stored in the pixel current value memory 23. Since the measurement of the pixel current value is performed in a state that the leak-current components are almost removed, the pixel current value can be measured with high accuracy for each of the pixel portions $PL_{1,1}$ to $PL_{n,m}$. Furthermore, an offset current value is set respectively for a display panel when the above-described leak-current cancelling routine and light-emission drive current measuring routine described above are used, the pixel current value can be measured for each of the pixel portions $PL_{1,1}$ to $PL_{n,m}$ with high accuracy.

Figure 22:
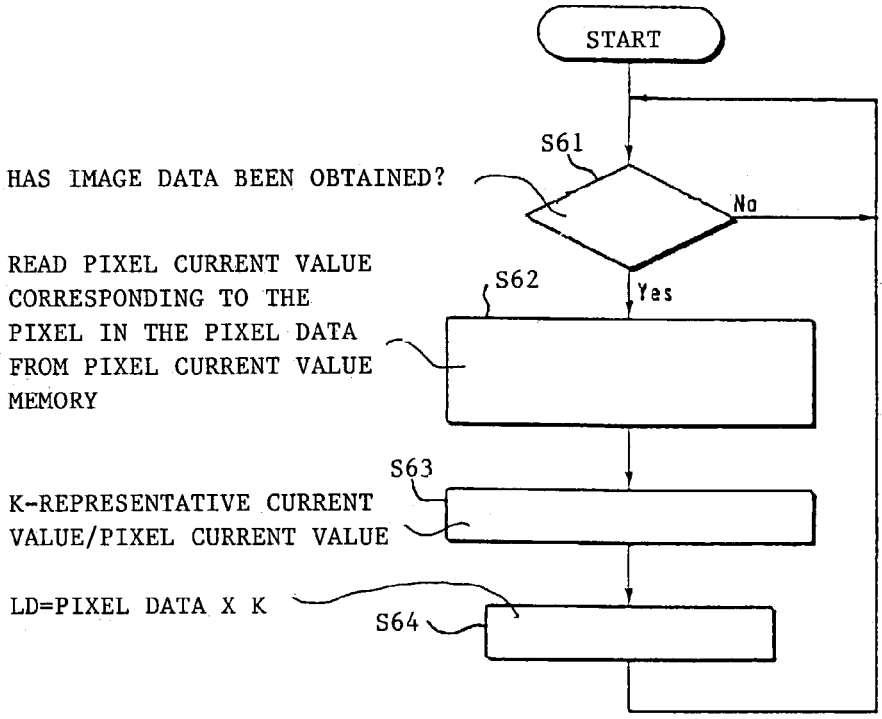
FIG. 22 is a flowchart showing the luminance correction value generating routine.

Then, for starting the display by the display panel 21, the luminance correction value generating routine shown in FIG. 22 is executed in order to generate the above-mentioned luminance correction value K corresponding to the pixel data in the input image data for each pixel.

The controller 22 first judges as to whether or not the image data is input and pixel data PD is obtained (step S61). The step S21 is repeatedly executed until the pixel data PD is obtained. The controller 22 then reads-out the pixel current value corresponding to that pixel data PD from the pixel current value memory 23 (Step S62). The controller then obtains a result of division of the representative value stored in the internal register by the above-described pixel current value, as the luminance correction value K (S63), and calculates the luminance corrected pixel data LD by multiplying the luminance correction value K to the pixel data PD (S64). In step S64, the luminance corrected pixel data LD is obtained in the way expressed by the following equation.

$$LD = \text{pixel data } PD \cdot \text{luminance correction value } K$$

$$= \text{pixel data } PD \cdot (\text{representative value}/\text{pixel current value})$$

The controller 22 repeats the processes of the steps S61 to S64 until the display of the screen is turned off, so as to obtain the luminance corrected pixel data PD for each of the pixels.

By the execution of the luminance correction value generating routine described above, the luminance correction value K is obtained in such a way that the larger the light-emission driving current measured for each of the pixel relative to the representative current value mentioned above, the shorter the period of light-emission of the EL element in the pixel portion corresponding to that pixel relative to the period indicated by the pixel data PD of that pixel. Thus, the value obtained by multiplying the above-described luminance correction value K to the pixel data PD supplied in correspondence with the pixel is used as the luminance corrected pixel data LD.

For instance, when the current value of the pixel portion $PL_{1,1}$ is 120% of the representative value mentioned above, the luminance correction value K becomes equal to 0.83, so that the value obtained by multiplying 0.83 to the pixel data supplied for the pixel portion $PL_{1,1}$ is used as the luminance corrected pixel data LD. Similarly, when the current value of the pixel portion $PL_{1,2}$ is 110% of the representative value mentioned above, the luminance correction value K becomes equal to 0.91, so that the value obtained by multiplying 0.91 to the pixel data supplied for the pixel portion PL1,2 is used as the luminance corrected pixel data LD.

That is, the luminance correction is effected to the pixel data PD in such a way that the light-emission period within one frame is shorter for the pixel portion having an EL element of which the driving current is large, than the EL element of which the driving current is small. Briefly speaking, although the luminance of light emitted by the EL element having a larger driving current becomes large, the apparent luminance of the EL element in the screen is made uniform by shortening the light-emission period within one frame by the pixel data PD corresponding to the EL element having a large driving current to a degree coping with the increase in luminance.

Even if the luminance of light emitted from each of the EL elements varies from one device to the other due to long-term use of the display panel 21, high-quality display that is free from the unevenness of luminance can be presented according to the present invention.

In the embodiment described above, the lowest current value among the pixel current values stored in the pixel current value memory 23 is used as the representative current value. However, the highest current value may be used as the representative current value. In that case, in step S58 shown in FIG. 21, the controller 22 searches for the highest current value from among the respective pixel current values of the pixels that have been stored in the pixel current memory 23, and stores the searched out current value in the internal register as the representative current value. Through this process, a luminance correction is effected to the pixel data in such a way that the lower the light-emission drive current, the longer the light-emission period of the EL element, while using an EL element whose light-emission drive current is the highest as a reference. The luminance correction value K always has a value greater than 1. Therefore, when multiplying the luminance correction value K to the pixel data PD to derive the luminance corrected pixel data LD, a predetermined coefficient that is smaller than 1 is further multiplied to the result of the first multiplication. For instance, when the predetermine coefficient is 0.7, the luminance corrected pixel data LD is computed as expressed by the following equation.

$$LD = \text{pixel data } PD \cdot 0.7 \cdot \text{luminance correction coefficient } K$$
$$= \text{pixel data } PD \cdot 0.7 \cdot (\text{representative current value}/\text{pixel current value})$$

Furthermore, in the embodiment described above, the pixel current values each of which has been acutually measured for each of the pixels are stored in the pixel current value memory 23. However, it is also possible to store the differences respectively between the pixel current values and the above-described representative current value in the pixel current value memory 23, correspondingly to respective pixels.

Figure 23:
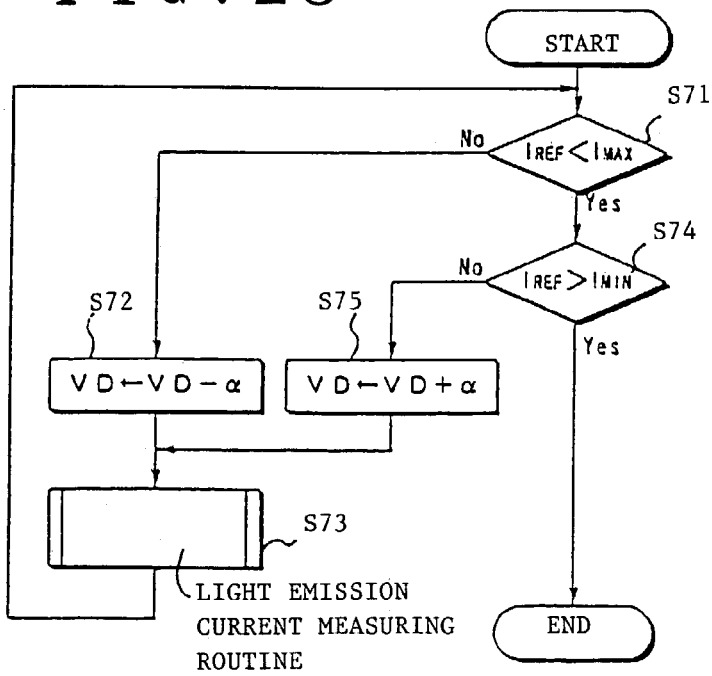
FIG. 23 is a flowchart showing the drive voltage setting routine.

It is also possible to adopt an arrangement that the controller 22 proceeds to the execution of a drive voltage setting routine shown in FIG. 23 after the execution of the light-emission drive current measuring routine.

In FIG. 23, first, the controller 22 executes a judgement as to whether or not the representative current value $I_{REF}$ stored in the internal register mentioned above is lower than a predetermined upper limit current value $I_{MAX}$ (step S31). The upper limit current value $I_{MAX}$ is an upper limit value of the light emission driving current that causes the EL element in the pixel portion to emit light at a luminance above a minimum necessary level, while maintaining the electric power consumption to be lower than a predetermined value. If it is judged in step S71 that the representative current value $I_{REF}$ is not lower than the predetermined upper limit current value $I_{MAX}$, the controller 22 supplies a drive voltage designating signal VD, that is obtained by subtracting a predetermined voltage value á from the voltage value having been designated by the drive voltage designating signal VD until an immediately preceding time, to the power supply circuit 27 (step S72). As a result of execution of the step S72, the power supply circuit 27 supplies a drive voltage Vc having been decreased by the predetermined voltage value á to the power supply line Z. The controller 22 then executes the above-described light-emission driving current measuring routine once again (step S73). This means that the light-emission drive current is measured once again for each of the EL elements in the pixel portions $PL_{1,1}$ to $PL_{n,m}$ respectively, in a state that the drive voltage Vc being applied to the power supply line Z has been decreased by the predetermined voltage á by the execution of the step S72. After the execution of the step S73, the controller 22 returns to the execution of the step S31, to executes the above-described processes repeatedly. Briefly speaking, the controller 22 repeats the process to decrease the drive voltage Vc to be applied to the power supply line V by the predetermined value á until the representative current value $I_{REF}$ becomes lower than the upper limit current value $I_{MAX}$.

In step 71 described above, if it is judged that the representative current value $I_{REF}$ is smaller than the upper limit current value $I_{MAX}$, the controller 22 then performs the judgment as to whether or not the representative current value $I_{REF}$ is greater than a lower limit current value $I_{MIN}$ (step 74). The lower limit current value $I_{MIN}$ is a lower limit value of the light emission driving current that causes the EL element to emit light at the minimum necessary luminance level. If it is judged in step S74 that the representative current value $I_{REF}$ is not higher than the lower limit current value $I_{MIN}$, the controller 22 supplies a drive voltage designating signal VD, that is obtained by adding the predetermined voltage value á to the voltage value having been designated by the drive voltage designating signal VD until an immediately preceding time, to the power supply circuit 27 (step S75). As a result of execution of the step S75, the power supply circuit 27 supplies a drive voltage Vc having been increased by the predetermined voltage value á to the power supply line Z. After the execution of the step S75, the controller 22 proceeds to the execution of the light-emission driving current measuring routine in step S73. This means that the light-emission drive current is measured once again for each of the EL elements in the pixel portions $PL_{1,1}$ to $PL_{n,m}$ respectively, in a state that the drive voltage Vc being applied to the power supply line Z has been increased by the predetermined voltage á by the execution of the step S72. After the execution of the step S73, the controller 22 returns to the execution of the step S71, to execute the above-described processes repeatedly. Briefly speaking, the controller 22 repeats the process to decrease the drive voltage Vc to be applied to the power supply line V by the predetermined value á until the representative current value $I_{REF}$ becomes higher than the upper limit current value $I_{MIN}$.

In step 74 described above, if it is judged that the representative current value $I_{REF}$ is greater than the lower limit current value $I_{MIN}$, it means that the representative current value $I_{REF}$ lies in the range between the lower limit current value $I_{MIN}$ and the upper limit current value $I_{MAX}$, the controller 22 exits from the drive voltage setting routine and returns to the execution of the main routine (not shown).

As described above, by the execution of the drive voltage setting routine, the drive voltage is adjusted so that the smallest one of the light-emission drive currens each of which flows through each of the pixel portions $PL_{1,1}$ to $PL_{n,m}$ becomes equal to the light-emittion drive current necessary for driving the EL element to emit light within the desired range of luminance.

Also, an upper limit may be set for the drive voltage Vc in order to protect the display panel.

With the features described above, even if fluctuation of the internal resistance of the EL element is caused such reasons as the temperature change or the accumulated of the light-emission period, it is possible to maintain the luminance level of the whole display area of the display panel 21.

As described above, according to the present invention, it is possible to display images at high quality without fluctuation of luminance even if the display apparatus is used for a long time.

This application is based on Japanese Patent Applications Nos. 2001-401814, 2001-401815, and 2002-201697 which are herein incorporated by reference.

What is claimed is:

1. A display panel driving device for driving a display panel formed by a matrix-type arrangement of a plurality of emitting elements supporting pixels, comprising:

a drive voltage generator supplying a drive voltage through a power line to each of said plurality of emitting elements;

a current measuring part for measuring a current value by fetching a value of current flowing in said power line while causing said emitting elements to independently emit light in succession, with the timing of the light-emission time of each said emitting element, and storing the current values thus acquired in a memory as measured current values each assigned to each pixel;

a luminance correction part for obtaining luminance-corrected pixel data by correcting the luminance level indicated by the pixel data of each pixel corresponding to an input image signal, based on said measured current value stored in said memory for one of said pixels according to said pixel data;

a light-emission drive part for causing said light-emission elements to emit light only for the period corresponding to said luminance-corrected pixel data during the image display light-emission periods in each frame period in said input image signal, wherein said current measuring part comprises:

non-light emission current measuring part for obtaining, as a non-light emission current value, the value of the current flowing in said power line when all said light-emission elements formed in said display panel are extinguished;

light-emission current measuring part for obtaining, as a light-emission drive current, the value of current flowing in said power line while causing said emitting elements to independently emit light in succession, with the timing of the light-emission time of each said emitting element; and a part for storing in said memory the result of subtracting said non-light emission current value from said light-emission drive current value, as said measured current value.

2. A display panel driving device for driving a display panel formed by a matrix-type arrangement of a plurality of emitting elements supporting pixels, comprising:

a drive voltage generator supplying a drive voltage through a power line to each of said plurality of emitting elements;

a current measuring part for measuring a current value by fetching a value of current flowing in said power line while causing said emitting elements to independently emit light in succession, with the timing of the light-emission time of each said emitting element, and storing the current values thus acquired in a memory as measured current values each assigned to each pixel;

a luminance correction part for obtaining luminance-corrected pixel data by correcting the luminance level indicated by the pixel data of each pixel corresponding to an input image signal, based on said measured current value stored in said memory for one of said pixels according to said pixel data; and a light-emission drive part for causing said light-emission elements to emit light only for the period corresponding to said luminance-corrected pixel data during the image display light-emission periods in each frame period in said input image signal, wherein said luminance correction part comprises:

a luminance correction value calculating part for calculating the luminance correction value, for determining a luminance correction value from said measured current value assigned to one of said pixels corresponding to said pixel data; and a multiplier for obtaining a product of multiplying said pixel data by said luminance correction value, as said luminance-corrected pixel data, wherein the luminance level is corrected based on a value obtained by subtracting a non-light emission current value from a light-emission drive current value.

3. A display panel driving device for driving a display panel formed by a matrix-type arrangement of a plurality of emitting elements supporting pixels, comprising:

a drive voltage generator supplying a drive voltage through a power line to each of said plurality of emitting elements;

a current measuring part for measuring a current value by fetching a value of current flowing in said power line while causing said emitting elements to independently emit light in succession, with the timing of the light-emission time of each said emitting element, and storing the current values thus acquired in a memory as measured current values each assigned to each pixel;

a luminance correction part for obtaining luminance-corrected pixel data by correcting the luminance level indicated by the pixel data of each pixel corresponding to an input image signal, based on said measured current value stored in said memory for one of said pixels according to said pixel data; and a light-emission drive part for causing said light-emission elements to emit light only for the period corresponding to said luminance-corrected pixel data during the image display light-emission periods in each frame period in said input image signal, wherein said luminance correction part comprises:

a luminance correction value calculating part for calculating the luminance correction value, for determining a luminance correction value from said measured current value assigned to one of said pixels corresponding to said pixel data; and a multiplier for obtaining a product of multiplying said pixel data by said luminance correction value, as said luminance-corrected pixel data, wherein said luminance correction value calculating part obtains said luminance-corrected values that become smaller as said measured current values increase.

4. A display panel driving device for driving a display panel formed by a matrix-type arrangement of a plurality of emitting elements supporting pixels, comprising:

a drive voltage generator supplying a drive voltage through a power line to each of said plurality of emitting elements;

a current measuring part for measuring a current value by fetching a value of current flowing in said power line while causing said emitting elements to independently emit light in succession, with the timing of the light-emission time of each said emitting element, and storing the current values thus acquired in a memory as measured current values each assigned to each pixel;

a luminance correction part for obtaining luminance-corrected pixel data by correcting the luminance level indicated by the pixel data of each pixel corresponding to an input image signal, based on said measured current value stored in said memory for one of said pixels according to said pixel data; and a light-emission drive part for causing said light-emission elements to emit light only for the period corresponding to said luminance-corrected pixel data during the image display light-emission periods in each frame period in said input image signal, wherein said luminance correction part comprises:

a luminance correction value calculating part for calculating the luminance correction value, for determining a luminance correction value from said measured current value assigned to one of said pixels corresponding to said pixel data; and a multiplier for obtaining a product of multiplying said pixel data by said luminance correction value, as said luminance-corrected pixel data, wherein said luminance correction value calculating part obtains said luminance-corrected values that become larger as said measured current values decrease.

5. A display panel driving device for driving a display panel formed by a matrix-type arrangement of a plurality of emitting elements supporting pixels, comprising:

a drive voltage generator supplying a drive voltage through a power line to each of said plurality of emitting elements;

a current measuring part for measuring a current value by fetching a value of current flowing in said power line while causing said emitting elements to independently emit light in succession, with the timing of the light-emission time of each said emitting element, and storing the current values thus acquired in a memory as measured current values each assigned to each pixel;

a luminance correction part for obtaining luminance-corrected pixel data by correcting the luminance level indicated by the pixel data of each pixel corresponding to an input image signal, based on said measured current value stored in said memory for one of said pixels according to said pixel data;

a light-emission drive part for causing said light-emission elements to emit light only for the period corresponding to said luminance-corrected pixel data during the image display light-emission periods in each frame period in said input image signal; and part for detecting malfunctioning pixels that correspond to measured current values, among said measured current values stored in said memory, lying outside a specified current value range; wherein said light-emission drive part comprises part for forbidding the light-emission operation for those light-emission elements corresponding to said malfunctioning pixels.

6. A display panel driving device for driving a display panel formed by a matrix-type arrangement of a plurality of emitting elements supporting pixels, comprising:

a drive voltage generator supplying a drive voltage through a power line to each of said plurality of emitting elements;

a current measuring part for measuring a current value by fetching a value of current flowing in said power line while causing said emitting elements to independently emit light in succession, with the timing of the light-emission time of each said emitting element, and storing the current values thus acquired in a memory as measured current values each assigned to each pixel;

a luminance correction part for obtaining luminance-corrected pixel data by correcting the luminance level indicated by the pixel data of each pixel corresponding to an input image signal, based on said measured current value stored in said memory for one of said pixels according to said pixel data; and a light-emission drive part for causing said light-emission elements to emit light only for the period corresponding to said luminance-corrected pixel data during the image display light-emission periods in each frame period in said input image signal, wherein said current measuring part comprises:

scanning light-emission drive part for causing said emitting elements to independently emit light in succession;

a current detection circuit for detecting a value of current flowing in said power line; and a part for acquiring the current value detected by said current detection circuit with the timing of the light-emission time of each said emitting element, and storing this current value in said memory as measured current values each assigned to said each pixel, wherein said drive voltage generator circuit comprises:

a first drive voltage generator circuit which supplies a drive voltage through a first power line to each light-emission elements supporting red light-emission among said light-emission elements formed in said display panel;

a second drive voltage generator circuit which supplies a drive voltage through a second power line to each light-emission element supporting blue light-emission among said light-emission elements formed in said display panel; and a third drive voltage generator circuit which supplies a drive voltage through a third power line to each light-emission element supporting green light-emission among said light-emission elements formed in said display panel; and wherein said current detection circuit comprises a first current detection circuit for detecting the current flowing in said first power line; a second current detection circuit for detecting the current flowing in said second power line; and a third current detection circuit for detecting the current flowing in said third power line, wherein the luminance level is corrected based on a value obtained by subtracting a non-light emission current value from a light-emission drive current value.

7. A display panel driving method for driving a display panel formed by a matrix-type arrangement of a plurality of emitting elements supporting pixels, comprising:

a current measuring step of obtaining the measured current value corresponding to each pixel by fetching the value of current flowing in said power line while causing said emitting elements to independently emit light in succession, with the timing of the light-emission time of each said emitting element;

a luminance correction step for obtaining luminance-corrected pixel data by correcting the luminance level indicated by the pixel data of each pixel corresponding to the input image signal, based on said measured current value for one of the pixels according to said pixel data;

light-emission drive step for causing said light-emission elements to emit light only for the period corresponding to said luminance-corrected pixel data during the image display light-emission periods in each frame period in said input image signal, wherein said current measuring step comprises a non-light emission current measuring step for obtaining, as the non-light emission current value, a value of the current flowing in said power line when all said light-emission elements formed in said display panel are extinguished;

a light-emission current measuring step for obtaining a light-emission drive current value by fetching a value of current flowing in said power line while causing said emitting elements to independently emit light in succession, with the timing of the light-emission time of each said emitting element; and a step for subtracting said non-light emission current value from said light-emission drive current value, and taking the subtraction result as said measured current value.

8. A display panel driving method for driving a display panel formed by a matrix-type arrangement of a plurality of emitting elements supporting pixels, comprising:

a current measuring step of obtaining the measured current value corresponding to each pixel by fetching the value of current flowing in said power line while causing said emitting elements to independently emit light in succession, with the timing of the light-emission time of each said emitting element;

a luminance correction step for obtaining luminance-corrected pixel data by correcting the luminance level indicated by the pixel data of each pixel corresponding to the input image signal, based on said measured current value for one of the pixels according to said pixel data; and light-emission drive step for causing said light-emission elements to emit light only for the period corresponding to said luminance-corrected pixel data during the image display light-emission periods in each frame period in said input image signal;

wherein said luminance correction step further comprises:

a luminance correction value calculating step for determining the luminance correction value from said measured current value assigned to one of said pixels corresponding to said pixel data; and a multiplying step for determining, as said luminance-corrected pixel data, a product obtained by multiplying said pixel data by said luminance correction value, wherein the luminance level is corrected based on a value obtained by subtracting a non-light emission current value from a light-emission drive current value.

9. A display panel driving method for driving a display panel formed by a matrix-type arrangement of a plurality of emitting elements supporting pixels, comprising:

a current measuring step of obtaining the measured current value corresponding to each pixel by fetching the value of current flowing in said power line while causing said emitting elements to independently emit light in succession, with the timing of the light-emission time of each said emitting element;

a luminance correction step for obtaining luminance-corrected pixel data by correcting the luminance level indicated by the pixel data of each pixel corresponding to the input image signal, based on said measured current value for one of the pixels according to said pixel data; and light-emission drive step for causing said light-emission elements to emit light only for the period corresponding to said luminance-corrected pixel data during the image display light-emission periods in each frame period in said input image signal;

wherein said luminance correction step further comprises:

a luminance correction value calculating step for determining the luminance correction value from said measured current value assigned to one of said pixels corresponding to said pixel data; and a multiplying step for determining, as said luminance-corrected pixel data, a product obtained by multiplying said pixel data by said luminance correction value;

wherein said luminance correction value calculating step obtains said luminance-corrected values that become smaller as said measured current values increase.

10. A display panel driving method for driving a display panel formed by a matrix-type arrangement of a plurality of emitting elements supporting pixels, comprising:

a current measuring step of obtaining the measured current value corresponding to each pixel by fetching the value of current flowing in said power line while causing said emitting elements to independently emit light in succession, with the timing of the light-emission time of each said emitting element;

a luminance correction step for obtaining luminance-corrected pixel data by correcting the luminance level indicated by the pixel data of each pixel corresponding to the input image signal, based on said measured current value for one of the pixels according to said pixel data; and light-emission drive step for causing said light-emission elements to emit light only for the period corresponding to said luminance-corrected pixel data during the image display light-emission periods in each frame period in said input image signal;

wherein said luminance correction step further comprises:

a luminance correction value calculating step for determining the luminance correction value from said measured current value assigned to one of said pixels corresponding to said pixel data; and a multiplying step for determining, as said luminance-corrected pixel data, a product obtained by multiplying said pixel data by said luminance correction value;

wherein said luminance correction value calculating step obtains said luminance-corrected values that become larger as said measured current values decrease.

11. A display panel driving method for driving a display panel formed by a matrix-type arrangement of a plurality of emitting elements supporting pixels, comprising:

a current measuring step of obtaining the measured current value corresponding to each pixel by fetching the value of current flowing in said power line while causing said emitting elements to independently emit light in succession, with the timing of the light-emission time of each said emitting element;

a luminance correction step for obtaining luminance-corrected pixel data by correcting the luminance level indicated by the pixel data of each pixel corresponding to the input image signal, based on said measured current value for one of the pixels according to said pixel data;

light-emission drive step for causing said light-emission elements to emit light only for the period corresponding to said luminance-corrected pixel data during the image display light-emission periods in each frame period in said input image signal; and step for detecting malfunctioning pixels that correspond to measured current values, among said measured current values stored in said memory, lying outside a specified current value range; and wherein said light-emission drive step comprises step for forbidding the light-emission operation for said light-emission elements corresponding to said malfunctioning pixels.

12. A display panel driving device for driving, based on an input image signal, a display panel formed by a matrix-type arrangement of a plurality of emitting elements supporting pixels, comprising:

a drive voltage generator circuit which supplies a drive voltage through a power line to each of said plurality of emitting elements;

a current measuring part for obtaining a current value by fetching the value of current flowing in said power line while causing said emitting elements to independently emit light in succession, with the timing of the light-emission time of each said emitting element, and storing in a memory the measured current values thus obtained each assigned to each pixel;

drive voltage adjustment part for adjusting the voltage value of said drive voltage in such a manner that one of said measured light-emission drive current values becomes equal to a predetermined reference current value, wherein said current measuring part comprises:

non-light emission current measuring part for obtaining a value of current flowing in said power line when all said light-emission elements formed in said display panel are extinguished, as the non-light emission current value;

light-emission drive current measuring part for obtaining a current value by fetching the value of current flowing in said power line while causing said emitting elements to independently emit light in succession, with the timing of the light-emission time of each said emitting element, as the light-emission drive current value; and a part for storing in said memory the result of subtracting said non-light emission current value from said light-emission drive current value, as said measured current value.

13. The display panel driving device according to claim 12, further comprising:

a luminance correction part for obtaining luminance-corrected pixel data by correcting the luminance level indicated by the pixel data of each pixel corresponding to said input image signal, based on said measured current value stored in said memory for said one pixel according to said pixel data; and a light-emission drive part for causing said light-emission elements to emit light only for the period corresponding to said luminance-corrected pixel data during the image display light-emission periods in each frame period of said input signal.

14. A display panel driving device for driving, based on an input image signal, a display panel formed by a matrix-type arrangement of a plurality of emitting elements supporting pixels, comprising:

a drive voltage generator circuit which supplies a drive voltage through a power line to each of said plurality of emitting elements;

a current measuring part for obtaining a current value by fetching the value of current flowing in said power line while causing said emitting elements to independently emit light in succession, with the timing of the light-emission time of each said emitting element, and storing in a memory the measured current values thus obtained each assigned to each pixel; and drive voltage adjustment part for adjusting the voltage value of said drive voltage in such a manner that one of said measured light-emission drive current values becomes equal to a predetermined reference current value;

wherein said drive voltage adjustment part comprises:

a part for searching for the smallest current value among said measured current values stored in said memory, as the minimum measured current value; and a part for adjusting the voltage value of said drive voltage in such a manner that said minimum measured current value has the same current value as said reference current value, wherein the current measuring part further measures a non-light emission current value and a light-emission drive current value, and the drive voltage is adjusted based on a value obtained by subtracting the non-light emission current value from the light-emission drive current value.

15. The display panel driving device according to claim 14, wherein said drive voltage adjustment part comprises a part for adjusting the voltage value of said drive voltage in such a manner that the average value of said measured current values stored in said memory has the same current value as said reference current value.

16. The display panel driving device according to claim 14, wherein said drive voltage adjustment part comprise:

a part for adjusting the voltage value of said drive voltage in such a manner that the measured current value corresponding to predetermined one of said pixels among said measured current values stored in said memory, or the average value of the measured current values corresponding to a predetermined plurality of said pixels, has the same current value as said reference current value.

17. A display panel driving device for driving, based on an input image signal, a display panel formed by a matrix-type arrangement of a plurality of emitting elements supporting pixels, comprising:

a drive voltage generator circuit which supplies a drive voltage through a power line to each of said plurality of emitting elements;

a current measuring part for obtaining a current value by fetching the value of current flowing in said power line while causing said emitting elements to independently emit light in succession, with the timing of the light-emission time of each said emitting element, and storing in a memory the measured current values thus obtained each assigned to each pixel; and drive voltage adjustment part for adjusting the voltage value of said drive voltage in such a manner that one of said measured light-emission drive current values becomes equal to a predetermined reference current value;

wherein said current measuring part comprises:

scanning light-emission drive part for causing said emitting elements to independently emit light in succession;

a current detection circuit for detecting the value of current flowing in said power line; and a part for fetching the current value detected by said current detection part with the timing of the light-emission time of each said emitting element and store it in said memory, as said measured current value assigned to said each pixel;

wherein said drive voltage generator circuit comprises:

a first drive voltage generator circuit which supplies a drive voltage through a first power line to each light-emission element supporting red light-emission among said light-emission elements formed in said display panel;

a second drive voltage generator circuit which supplies a drive voltage through a second power line to each light-emission element supporting blue light-emission among said light-emission elements formed in said display panel; and a third drive voltage generator circuit which supplies a drive voltage through a third power line to each light-emission element supporting green light-emission among said light-emission elements formed in said display panel; and wherein said current detection circuit comprises:

a first current detection circuit for detecting the current flowing in said first power line; a second current detection circuit for detecting the current flowing in said second power line; and a third current detection circuit for detecting the current flowing in said third power line, wherein the current measuring part further measures a non-light emission current value and a light-emission drive current value, and the drive voltage is adjusted based on a value obtained by subtracting the non-light emission current value from the light-emission drive current value.

18. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured light-emission drive current values becomes equal to a predetermined reference current value, wherein said current measuring step comprises:

a non-light emission current measuring step for obtaining a value of the current flowing in said power line when all said light-emission elements formed in said display panel are extinguished, as the non-light emission current value;

a light-emission current measuring step for obtaining a light-emission drive current by fetching a value of current flowing in said power line while causing said emitting elements to independently emit light in succession, with the timing of the light-emission time of each said emitting element; and a step for subtracting said non-light emission current value from said light-emission drive current value, to obtain the subtraction result as said measured current value.

19. The display panel driving method according to claim 18, further comprising:

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input signal.

20. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element; and a drive voltage adjustment step for adjusting the voltage value of said drive voltage in such a manner that one among said measured light-emission drive current values becomes equal to a predetermined reference current value;

wherein said drive voltage adjustment step further comprises:

a step for searching for the smallest current value among said measured current values as the minimum measured current value; and a step for adjusting the value of said drive voltage in such a manner that said minimum measured current value has the same current value as said reference current value wherein said current measuring step comprises:

a non-light emission current step for obtaining, as the non-light emission current value, a value of the current flowing in said power line when all said light-emission elements formed in said display panel are extinguished;

a light-emission current measuring step for obtaining a light-emission drive current value by fetching a value of current flowing in said power line while causing said emitting elements to independently emit light in succession, with the timing of the light-emission time of each said emitting element; and a step for subtracting said non-light emission current value from said light-emission drive current value, and taking the subtraction result as said measured current value.

21. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element; and a drive voltage adjustment step for adjusting the voltage value of said drive voltage in such a manner that one among said measured light-emission drive current values becomes equal to a predetermined reference current value;

wherein said drive voltage adjustment step comprises the step of adjusting the voltage value of said drive voltage in such a manner that the average value of said measured current values has the same current value as said reference current value, wherein the current measuring part further measures a non-light emission current value and a light-emission drive current value, and the drive voltage is adjusted based on a value obtained by subtracting the non-light emission current value from the light-emission drive current value.

22. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element; and a drive voltage adjustment step for adjusting the voltage value of said drive voltage in such a manner that one among said measured light-emission drive current values becomes equal to a predetermined reference current value;

wherein said drive voltage adjustment step comprises the step of adjusting the voltage value of said drive voltages in such a manner that the measured current value corresponding to one predetermined pixel among said measured current values, or the average value of the measured current values corresponding to a predetermined plurality of pixels, has the same current value as said reference current value, wherein the current measuring part further measures a non-light emission current value and a light-emission drive current value, and the drive voltage is adjusted based on a value obtained by subtracting the non-light emission current value from the light-emission drive current value.

23. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal;

wherein said luminance correction part comprises:

a luminance correction value calculating part for determining the luminance correction value from said measured current value assigned to one of said pixels corresponding to said pixel data; and a multiplier for obtaining said luminance-corrected pixel data as the result of the product of said pixel data multiplied by said luminance correction value, wherein the luminance level is corrected based on a value obtained by subtracting a non-light emission current value from a light-emission drive current value.

24. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal;

wherein said luminance correction part comprises:

a luminance correction value calculating part for determining the luminance correction value from said measured current value assigned to one of said pixels corresponding to said pixel data; and a multiplier for obtaining said luminance-corrected pixel data as the result of the product of said pixel data multiplied by said luminance correction value, wherein said luminance correction value calculating part obtain said luminance-corrected values that become smaller as said measured current values increase.

25. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal;

wherein said luminance correction part comprises:

a luminance correction value calculating part for determining the luminance correction value from said measured current value assigned to one of said pixels corresponding to said pixel data; and a multiplier for obtaining said luminance-corrected pixel data as the result of the product of said pixel data multiplied by said luminance correction value, wherein said luminance correction value calculating part obtain said luminance-corrected values that become larger as said measured current values decrease.

26. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal; comprising:

a part for detecting malfunctioning pixels that correspond to measured current values, among said measured current values stored in said memory, lying outside a specified current value range;

wherein said light-emission drive part comprises part for forbidding the light-emission operation for said light-emission elements corresponding to said malfunctioning pixels.

27. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal;

wherein said drive voltage adjustment part comprises:

a part for searching for the smallest current value among said measured current values stored in said memory as the minimum measured current value; and a part for adjusting the voltage value of said drive voltage in such a manner that said minimum measured current value has the same current value as said reference current value, wherein the luminance level is corrected based on a value obtained by subtracting a non-light emission current value from a light-emission drive current value.

28. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal;

wherein said drive voltage adjustment part comprises a part for adjusting the voltage value of said drive voltage in such a manner that the average value of each said measured current values stored in said memory has the same current value as said reference current value, wherein the luminance level is corrected based on a value obtained by subtracting a non-light emission current value from a light-emission drive current value.

29. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal;

wherein said drive voltage adjustment part comprises:

a part for adjusting the voltage value of said drive voltage in such a manner that the measured current value corresponding to predetermined one of said pixels among said measured current values stored in said memory, or the average value of the measured current values corresponding to a predetermined plurality of said pixels, has the same current value as said reference current value, wherein the luminance level is corrected based on a value obtained by subtracting a non-light emission current value from a light-emission drive current value.

30. A display panel driving device for driving, based on an input image signal, a display panel formed by arranging a plurality of emitting elements supporting pixels in a matrix form, comprising:

a drive voltage generator circuit which supplies a drive voltage through a power line to each of said plurality of emitting elements;

a current measuring part for measuring a current value by fetching the value of current flowing in said power line while causing said emitting elements to independently emit light in succession, with the timing of the light-emission time of each said emitting element, and storing in a memory the measured current values each assigned to each pixel;

drive voltage adjustment part for adjusting the value of said drive voltage in such a manner that one value among said measured light-emission drive current values becomes equal to a predetermined reference current value;

a luminance correction part for obtaining luminance-corrected pixel data by correcting the luminance level indicated by the pixel data of each pixel corresponding to said input image signal, based on said measured current value stored in said memory for said one pixel according to said pixel data; and light-emission drive part for causing said light-emission elements to emit light only for the period corresponding to said luminance-corrected pixel data during the image display light-emission periods in each frame period of said input image signal wherein said current measuring part comprises:

scanning light-emission drive part for causing said emitting elements to independently emit light in succession;

a current detection circuit for detecting the value of current flowing in said power line; and a part for fetching the current valued detected by said current detection part with the timing of the light-emission time of each said emitting element, as said measured current value, and storing in said memory the measured current values each assigned to each said pixel wherein said drive voltage generator circuit comprises:

a first drive voltage generator circuit which supplies a drive voltage through a first power line to each light-emission element supporting red light-emission among said light-emission elements formed in said display panel;

a second drive voltage generator circuit which supplies a drive voltage through a second power line to each light-emission element supporting blue light-emission among said light-emission elements formed in said display panel; and a third drive voltage generator circuit which supplies a drive voltage through a third power line to each light-emission element supporting green light-emission among said light-emission elements formed in said display panel; and wherein said current detection circuit comprises: a first current detection circuit for detecting the current flowing in said first power line; a second current detection circuit for detecting the current flowing in said second power line; and a third current detection circuit for detecting the current flowing in said third power line, wherein the luminance level is corrected based on a value obtained by subtracting a non-light emission current value from a light-emission drive current value.

31. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input image signal;

wherein said luminance correction step comprises:

a luminance correction value calculating step for calculating the luminance correction value from said measured current value assigned to one of said pixels corresponding to said pixel data; and a multiplier for multiplying said pixel data by said luminance correction value for obtaining the product as said luminance-corrected pixel data, wherein the luminance level is corrected based on a value obtained by subtracting a non-light emission current value from a light-emission drive current value.

32. A display panel driving method for driving, based on input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light for the period corresponding to said luminance-corrected pixel data during the image display light-emission periods in each frame period of said input image signal;

wherein said luminance correction step comprises:

a luminance correction value calculating step for calculating the luminance correction value from said measured current value assigned to one of said pixels correspond to said pixel data; and a multiplier for multiplying said pixel data by said luminance correction value for obtaining the product as said luminance-corrected pixel data;

wherein said luminance correction value correcting step obtains said luminance-corrected values that become smaller as said measured current values increase.

33. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input image signal;

wherein said luminance correction step comprises:

a luminance correction value calculating step for calculating the luminance correction value from said measured current value assigned to one of said pixels corresponding to said pixel data; and a multiplier for multiplying said pixel data by said luminance correction value for obtaining the product as said luminance-corrected pixel data;

wherein said luminance correction value correcting step obtains said luminance-corrected values that become larger as said measured current values decrease.

34. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data;

a light-emission drive step for causing said light-emission elements to emit light only for the period corresponding to said luminance-corrected pixel data during the image display light-emission periods in each frame period of said input image signal; and a step of detecting malfunctioning pixels that correspond to measured current values, among said measured current values stored in said memory, lying outside a specified current value range;

wherein said light-emission drive step comprises a step of forbidding the light-emission operation for said light-emission elements corresponding to said malfunctioning pixels.

35. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input image signal;

wherein said drive voltage adjustment step further comprises the steps of:

searching for a smallest current value among said measured current value as the minimum measured current value; and adjusting the voltage value of said drive voltage in such a manner that said minimum measured current value has the same current value as said reference current value, wherein the luminance level is corrected based on a value obtained by subtracting a non-light emission current value from a light-emission drive current value.

36. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input image signal; and wherein said drive voltage adjustment step comprises the step of adjusting the voltage value of said drive voltage in such a manner that the average value of said measured current values has the same current value as said reference current value, wherein the luminance level is corrected based on a value obtained by subtracting a non-light emission current value from a light-emission drive current value.

37. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input image signal;

portions while sequentially causing said light-light-emission element to singularly emit light for each of said plurality of pixel portions, by respectively turning on said switch element of each of said plurality of pixel portions; and a luminance corrector for correcting the light-emission luminance output of the light emitting device of each of said plurality of pixel portions based on a corresponding one of measured current values stored in said memory, wherein the light-emission luminance output is corrected based on a value obtained by subtracting a non-light emission current value from a light-emission drive current value.

38. A drive apparatus of a display panel having a plurality of pixel portions arranged therein and each comprising a series circuit of a light-emission element and a switch element, for driving the display panel in response to an input image signal, comprising:

a drive voltage generator for applying a drive voltage to the series circuit of each of said plurality of pixel portions;

a current measuring part for measuring a value of a current supplied from said drive voltage generator to the series circuit of each of said plurality of pixel portions;

a current supplying part for adding to said current supplied from said drive voltage generator an off-set current component corresponding to a leak current of said display panel, and supplying a resultant current to the series circuit of each of said plurality of pixel portions;

a memory control part for storing in memory a measured current value by said current measuring part at a light-light-emission timing correspondingly to each of said plurality of pixel a current measuring part for measuring a value of a current supplied from said drive voltage generator to the series circuit of each of said plurality of pixel portions;

a current supplying part for adding to said current supplied from said drive voltage generator an off-set current component corresponding to a leak current of said display panel, and supplying a resultant current to the series circuit of each of said plurality of pixel portions;

a memory control part for storing in memory a measured current value by said current measuring part at a light-light-emission timing correspondingly to each of said plurality of pixel portions while sequentially causing said light-light-emission element to singularly emit light for each of said plurality of pixel portions, by respectively turning on said switch element of each of said plurality of pixel portions; and a luminance corrector for correcting the light-emission luminance output of the light emitting device of each of said plurality of pixel portions based on a corresponding one of measured current values stored in said memory, wherein said current supply part comprises a reading and judging part which reads a value of the current outputted from the drive current generating part when light-emitting devices of all of said plurality of pixel portions are in a light-off state, as a measured leak current, and judging as to whether or not the measured leak current is within a predetermined current range, and a controller which performs control operations of increasing the output current of said current supply part and making said reading and judging part perform said reading operation and judging operation once again when it is judged by said reading judging part that the measured leak current is outside the predetermined current range, and maintaining the output current of said current supply part as a value of said off-set current component when it is judged by said reading judging part that the measured leak current is within the predetermined current range.

39. The display panel driving apparatus of claim 38, wherein said off-set current component has a value selected to control a current outputted from said drive voltage generator when light-emitting devices of all of said plurality of pixel portions are in a light-off state.

40. The display panel driving apparatus of claim 38, wherein said luminance corrector comprises:

a luminance data corrector which corrects a luminance level indicated by pixel data for each of the pixels in said input video signal based on a measured current value among the measured current values of said plurality of pixel portions stored in said memory corresponding to said each of pixels, to obtain luminance corrected pixel data, and a light light-emission driver for driving said light-emission element to emit light for a period within an image displaying light-emission period in each frame period of said input video signal, wherein said period corresponds to said luminance corrected pixel data.

41. The display panel driving apparatus of claim 38, wherein said luminance corrector has a drive voltage adjuster for adjusting a voltage value of said drive voltage so that one of said measured current values becomes equal to a predetermined reference voltage.

42. The display panel driving apparatus of claim 38, wherein drive voltage generator, said current measuring part, and said current supply part are provided for each of light-emission colors of said light emitting elements.

43. A drive apparatus of a display panel having a plurality of pixel portions arranged therein and each comprising a series circuit of a light-emission element and a switch element, for driving the display panel in response to an input image signal, comprising:

a drive voltage generator for applying a drive voltage to the series circuit of each of said plurality of pixel portions;

wherein said drive voltage adjustment step comprises the step of adjusting the voltage value of said drive voltage in such a manner that the measured current value corresponding to predetermined one of pixels among said measured current values stored in said memory, or the average value of the measured current values corresponding to a predetermined plurality of pixels, has the same current value as said reference current value, wherein the luminance level is corrected based on a value obtained by subtracting a non-light emission current value from a light-emission drive current value.

44. The display panel driving apparatus of claim 43 wherein said reading and judging part is a circuit which converts said measured leak current value to digital data and performing a digital processing for said judging operation.

45. The display panel driving apparatus of claim 43 wherein said reading and judging part is a circuit which performs an analog processing for said judging operation in accordance with said measured leak current value having been read.

46. A display panel driving method for a display panel having a plurality of pixel portions arranged in a matrix form and each comprising a series circuit of a light-emission element and a switch element, for driving the display panel in accordance with an input image signal, comprising:

applying an output drive voltage of a drive voltage generator to the series circuit of each of said plurality of pixel portions;

supplying an addition value obtained by adding an off-set current component corresponding to a leak current of said display panel to said current supplied from said drive voltage generator, to the series circuit of each of said plurality of pixel portions;

measuring a value of a current supplied from said drive voltage generator to the series circuit of each of said plurality of pixel portions;

storing in memory a measured current value by measuring an output current value from said driving voltage generator at a light-emission timing correspondingly to each of said plurality of pixel portions while sequentially causing said light-emission element to singularly emit light for each of said plurality of pixel portions, by respectively turning on said switch element of each of said plurality of pixel portions; and correcting the light-emission luminance output of the light emitting device of each of said plurality of pixel portions based on a corresponding one of measured current values stored in said memory, wherein the light-emission luminance output is corrected based on a value obtained by subtracting a non-light emission current value from a light-emission drive current value.

* * * * *

UNITED STATES PATENT AND TRADEMARK OFFICE

CERTIFICATE OF CORRECTION

PATENT NO. : 7,274,363 B2
APPLICATION NO. : 10/322776
DATED : September 25, 2007
INVENTOR(S) : Shinichi Ishizuka et al.

It is certified that error appears in the above-identified patent and that said Letters Patent is hereby corrected as shown below:

Column 41, line 49, delete “multiplier” and insert --multiplying step--.

Column 42, lines 19 and 55, delete “multiplier” and insert --multiplying step--.

Column 44, lines 30-64 and column 45, lines 1-4, cancel the text in its entirety and insert the following claim wording as filed July 24, 2006 and allowed by the Examiner on October 17, 2006.

--37. A display panel driving method for driving, based on an input image signal, a display panel formed by a matrix-type arrangement of a plurality of emitting elements supporting pixels, comprising:

a current measuring step for obtaining a measured current value corresponding to each pixel by fetching the value of current flowing in said power line while causing said emitting elements to independently emit light in succession, with the timing of the light-emission time of each said emitting element;

a drive voltage adjustment step for adjusting the voltage value of said drive voltage in such a manner that one among said measured current values becomes equal to a predetermined reference current value;

a luminance correction step for obtaining luminance-corrected pixel data by correcting the luminance level indicated by the pixel data of each pixel corresponding to said input image signal, based on said measured current value stored in said memory for one of said pixels according to said pixel data; and a light-emission drive step for causing said light-emission elements to emit light only for the period corresponding to said luminance-corrected pixel data during the image display light-emission periods in each frame period of said input image signal;

wherein said drive voltage adjustment step comprises the step of adjusting the voltage value of said drive voltage in such a manner that the measured current value corresponding to predetermined one of pixels among said measured current values stored in said memory, or the average value of the measured current values corresponding to a predetermined plurality of pixels, has the same current value as said reference current value, wherein the luminance level is corrected based on a value obtained by subtracting a non-light emission current value from a light-emission drive current value--.

Column 45, lines 5-66, cancel the text in its entirety and insert the following claim wording as filed July 24, 2006 and allowed by the Examiner on October 17, 2006.

--38. A drive apparatus of a display panel having a plurality of pixel portions arranged therein and each comprising a series circuit of a light-emission element and a switch element, for driving the display panel in response to an input image signal, comprising:

It is certified that error appears in the above-identified patent and that said Letters Patent is hereby corrected as shown below:

a drive voltage generator for applying a drive voltage to the series circuit of each of said plurality of pixel portions;

a current measuring part for measuring a value of a current supplied from said drive voltage generator to the series circuit of each of said plurality of pixel portions;

a current supplying part for adding to said current supplied from said drive voltage generator an off-set current component corresponding to a leak current of said display panel, and supplying a resultant current to the series circuit of each of said plurality of pixel portions;

a memory control part for storing in memory a measured current value by said current measuring part at a light-emission timing correspondingly to each of said plurality of pixel portions while sequentially causing said light-emission element to singularly emit light for each of said plurality of pixel portions, by respectively turning on said switch element of each of said plurality of pixel portions; and a luminance corrector for correcting the light light-emission luminance output of the light emitting device of each of said plurality of pixel portions based on a corresponding one of measured current values stored in said memory, wherein the light-emission luminance output is corrected based on a value obtained by subtracting a non-light emission current value from a light-emission drive current value.--.

Column 46, line 12, delete “light light-emission” and insert --light emission--

Column 46, lines 26-44, cancel the text in its entirety and insert the following claim wording as filed July 24, 2006 and allowed by the Examiner on October 17, 2006.

--43. A drive apparatus of a display panel having a plurality of pixel portions arranged therein and each comprising a series circuit of a light-emission element and a switch element, for driving the display panel in response to an input image signal, comprising:

a drive voltage generator for applying a drive voltage to the series circuit of each of said plurality of pixel portions;

a current measuring part of measuring a value of a current supplied from said drive voltage generator to the series circuit of each of said plurality of pixel portions;

a current supplying part for adding to said current supplied from said drive voltage generator an off-set current component corresponding to a leak current of said display panel, and supplying a resultant current to the series circuit of each of said plurality of pixel portions;

UNITED STATES PATENT AND TRADEMARK OFFICE

CERTIFICATE OF CORRECTION

PATENT NO. : 7,274,363 B2
APPLICATION NO. : 10/322776
DATED : September 25, 2007
INVENTOR(S) : Shinichi Ishizuka et al.

It is certified that error appears in the above-identified patent and that said Letters Patent is hereby corrected as shown below:

a memory control part for storing in memory a measured current value by said current measuring part at a light-emission timing correspondingly to each of said plurality of pixel portions while sequentially causing said light-emission element to singularly emit light for each of said plurality of pixel portions, by respectively turning on said switch element of each of said plurality of pixel portions; and a luminance corrector for correcting the light-emission luminance output of the light emitting device of each of said plurality of pixel portions based on a corresponding one of measured current values stored in said memory, wherein said current supply part comprises a reading and judging part which reads a value of the current outputted from the drive current generating part when light-emitting devices of all of said plurality of pixel portions are in a light-off state, as a measured leak current, and judging as to whether or not the measured leak current is within a predetermined current range, and a controller which performs control operations of increasing the output current of said current supply part and making said reading and judging part perform said reading operation and judging operation once again when it is judged by said reading judging part that the measured leak current is outside the predetermined current range, and maintaining the output current of said current supply part as a value of said off-set current component when it is judged by said reading judging part that the measured leak current is within the predetermined current range.--.

Signed and Sealed this

Tenth Day of February, 2009

John Doll

JOHN DOLL
*Acting Director of the United States Patent and Trademark Office*